US011124992B2

(12) United States Patent
Moon et al.

(10) Patent No.: US 11,124,992 B2
(45) Date of Patent: Sep. 21, 2021

(54) SLIDING ACTUATOR ASSEMBLY FOR A LATCHSET

(71) Applicant: TOWNSTEEL, INC., Industry, CA (US)

(72) Inventors: Charles W. Moon, Colorado Springs, CO (US); Sybor Ma, La Puente, CA (US)

(73) Assignee: Townsteel, Inc., City of Industry, CA (US)

( * ) Notice: Subject to any disclaimer, the term of this patent is extended or adjusted under 35 U.S.C. 154(b) by 1158 days.

(21) Appl. No.: 15/393,712

(22) Filed: Dec. 29, 2016

(65) Prior Publication Data

US 2018/0187454 A1 Jul. 5, 2018

(51) Int. Cl.

| | |
|---|---|
| ***E05B 59/00*** | (2006.01) |
| ***E05B 63/00*** | (2006.01) |
| ***E05B 63/04*** | (2006.01) |
| *E05B 47/06* | (2006.01) |
| *E05B 63/06* | (2006.01) |
| *E05B 1/00* | (2006.01) |

(52) U.S. Cl.

CPC ..... *E05B 59/00* (2013.01); *E05B 63/0065* (2013.01); *E05B 63/04* (2013.01); *E05B 47/0657* (2013.01); *E05B 47/0676* (2013.01); *E05B 63/06* (2013.01); *E05B 2001/0076* (2013.01)

(58) Field of Classification Search

CPC ..... E05B 59/00; E05B 63/0065; E05B 63/04; E05B 2001/0076; E05B 63/06; E05B 47/0657; E05B 47/0676; E05B 15/00; E05B 3/00

See application file for complete search history.

(56) References Cited

U.S. PATENT DOCUMENTS

| | | | |
|---|---|---|---|
| 3,791,180 | A | 2/1974 | Doyle |
| 3,875,772 | A | 4/1975 | Ebersman et al. |
| 3,910,613 | A | 10/1975 | Nolin |
| 4,418,552 | A | 12/1983 | Nolin |
| 4,516,798 | A | 5/1985 | Bergen |

(Continued)

OTHER PUBLICATIONS

"EP-55 Preview." Victor Keyless Lock Inc. N.p., n.d. Web. Jan. 9, 2017. http://www.victorelock.com/Manuals. pp. 1-29.

*Primary Examiner* — Kristina R Fulton

*Assistant Examiner* — Thomas L Neubauer

(74) *Attorney, Agent, or Firm* — Eric W. Cernyar; James W. Huffman

(57) ABSTRACT

A latchset comprises a latch cam hub configured to rotate on a door handle tailpiece, a first and optionally also a second projection extending radially outward from the hub, a sliding actuator comprising an elongated body and a first tooth, and a spring that resists retraction of the sliding actuator and urges the first projection against the first tooth. The latch cam is operative to retract the sliding actuator when a coupled door handle is rotated in only one rotational direction, such that rotation of the coupled door handle in the opposite rotational direction is inoperative to retract the sliding actuator. The hub is configured to be rotated by 90° during installation to set the latch cam to operate in an oppositely handed door. The latch cam prevents lost motion in eight door configurations.

20 Claims, 22 Drawing Sheets

(56) References Cited

U.S. PATENT DOCUMENTS 4,606,203 A * 8/1986 Esser ..... E05B 59/00 70/107
5,257,837 A * 11/1993 Bishop ..... E05B 63/06 292/1.5
5,257,838 A * 11/1993 Lin ..... E05B 63/06 292/1.5
5,325,687 A 7/1994 Lin
5,490,695 A * 2/1996 Shiue ..... E05B 55/005 292/1.5
5,496,082 A 3/1996 Zuckerman
5,551,736 A * 9/1996 Fann ..... E05B 63/06 292/1.5
5,611,581 A 3/1997 Ghostley
5,620,211 A * 4/1997 Ellis ..... E05B 55/005 292/1.5
5,657,653 A 8/1997 Hensley et al.
5,713,612 A 2/1998 Kajuch
6,128,933 A 10/2000 Mirshafiee et al.
6,419,288 B1 7/2002 Wheatland
6,581,426 B2 6/2003 Bates et al.
6,584,818 B2 7/2003 Bates et al.
6,612,141 B2 9/2003 Bates et al.
6,615,629 B2 9/2003 Bates et al.
7,257,973 B2 8/2007 Romero et al.
7,363,784 B2 4/2008 Shvarts
7,856,856 B2 12/2010 Shvartx
8,201,858 B1 6/2012 Moon et al.
8,292,336 B2 10/2012 Moon
8,419,086 B2 4/2013 Moon
8,424,935 B2 4/2013 Moon
8,844,330 B2 9/2014 Moon et al.
9,033,375 B1 5/2015 Moon et al.
9,394,722 B2 7/2016 Moon et al.
9,528,300 B2 12/2016 Moon et al.
2001/0025517 A1 10/2001 Bates et al.
2001/0028172 A1 10/2001 Bates et al.
2002/0017121 A1 2/2002 Bates et al.
2002/0092557 A1 7/2002 Ghoshal
2002/0096888 A1 7/2002 Bates et al.
2002/0096891 A1 7/2002 Bates et al.
2012/0167646 A1 7/2012 Sharma et al.
2016/0298358 A1 10/2016 Moon
2016/0298360 A1 10/2016 Moon
2016/0305160 A1 10/2016 Moon et al.

* cited by examiner

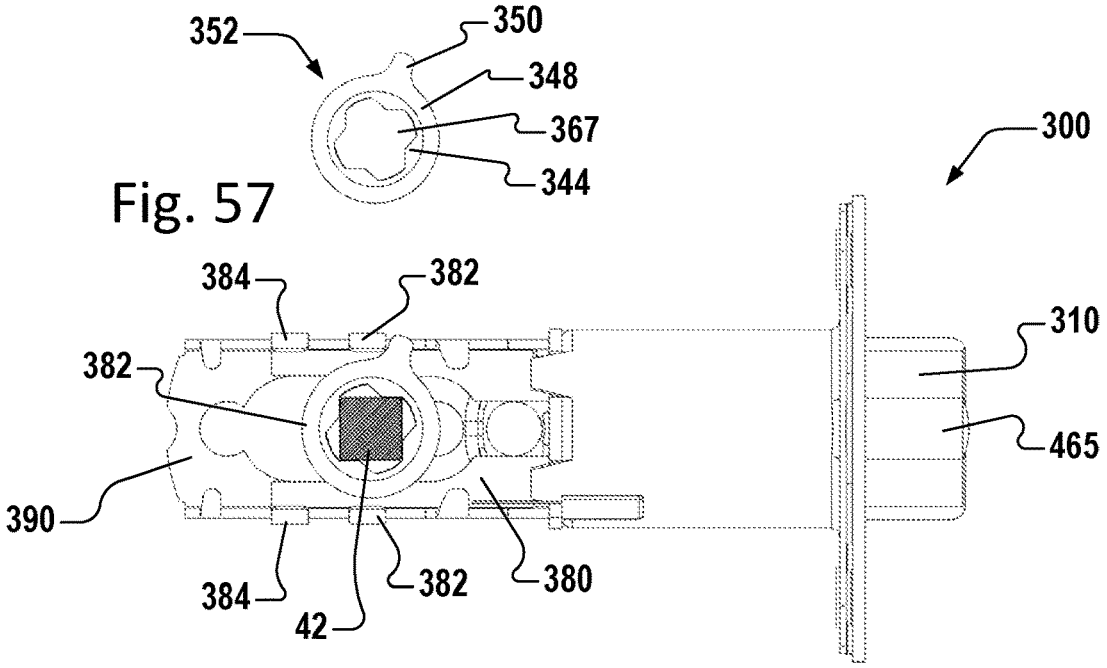
Fig. 57
Fig. 58
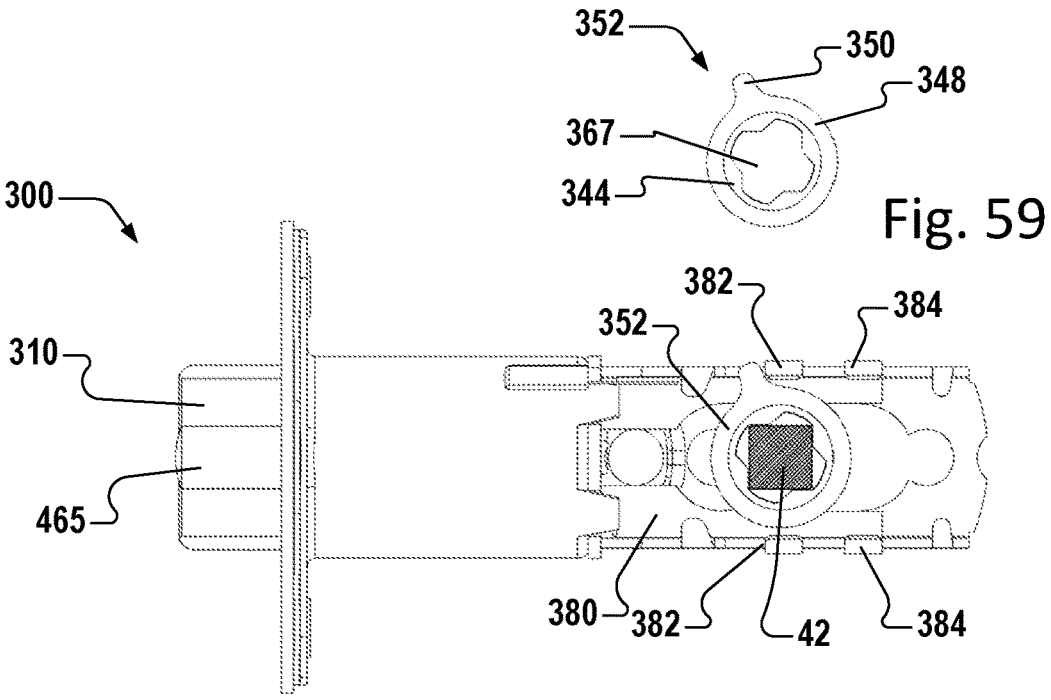
Fig. 59
Fig. 60

SLIDING ACTUATOR ASSEMBLY FOR A LATCHSET

TECHNICAL FIELD

The present disclosure generally relates to latchsets, and in particular, to sliding actuator assemblies for latchsets.

BACKGROUND

Doors are often installed with two latches. The first is typically a retractable latch, and the second is typically a deadbolt that provides greater security. However, manufacturers found that in cases where both latches were latched and room occupants panicked while trying to exit, the action of manually unlocking both latches was difficult. Single action, double bolt release locksets were developed to allow occupants to turn one door knob or lever and unlatch both bolts.

Since that time, changes have been made to individual types of latches and to mechanisms that might connect one latch to another.

However, there is need in the art for a double latch lockset that improves convenience, efficiency, and safety.

SUMMARY

A latchset with a sliding actuator assembly comprises a novel latch cam. The latch cam comprises a hub configured to rotate on a door handle tailpiece, a first projection extending radially outward from the hub, a sliding actuator comprising an elongated body and a first tooth, and a spring that resists retraction of the sliding actuator and urges the first projection against the first tooth. When installed for a right-hand door, the latch cam is operative to retract the sliding actuator when a coupled door handle is rotated in only one rotational direction, such that rotation of the coupled door handle in the opposite rotational direction is inoperative to retract the sliding actuator.

In one embodiment, the sliding actuator assembly of claim 1 further comprises a second projection extending radially outward from the hub. However, the first projection is operative in only a right-handed configuration for use in a right-handed door, and the second projection is operative in only a left-handed configuration for use in a left-handed door.

In another embodiment, the sliding actuator comprises a second tooth disposed opposite of the first tooth. The first and second projections are spaced apart such that when the sliding actuator assembly is installed with a right-handed configuration for use in a right-handed door, the second projection is unable to come into contact with the second tooth. When the sliding actuator assembly is installed with a left-handed configuration for use in a left-handed door, the first projection is unable to come into contact with the first tooth.

In another latchset, a novel latch cam comprises a hub comprising a square aperture and first and second projections extending outwardly from the hub, wherein the first and second projections are symmetrically opposed with reference to a diagonal of the square aperture. Moreover, the hub is configured to be rotated by 90° during installation to set the latch cam to operate in an oppositely handed door.

In one implementation, the latch cam further comprises a ring about the outer surface of the hub, wherein the distance between the ends of the first and second projections is less than the diameter of the ring. In another implementation, the distance between the ends of the first and second projections approximates the length of a diagonal of the square aperture.

Various electronic actuators, switches, controllers, and other devices may be employed with the latchsets and its components. The resultant latchsets may be fully or largely mechanical, electronic, or a combination thereof.

Kits are envisioned comprised of various combinations, including, but not limited to a first retractable latch, a second retractable latch, a deadbolt, inside and/or outside actuators for the latches, drive assemblies, clutch assemblies, a locking rack and pinion, sliding actuator assemblies, latch cams, latch bolt assemblies, and a latch bolt tail.

Other systems, devices, methods, features, and advantages of the disclosed product, kits, and methods for forming a double latch lockset and parts of locksets will be apparent or will become apparent to one with skill in the art upon examination of the following figures and detailed description. All such additional systems, devices, methods, features, and advantages are intended to be included within the description and to be protected by the accompanying claims.

BRIEF DESCRIPTION OF THE DRAWINGS

The present disclosure may be better understood with reference to the following figures. Corresponding reference numerals designate corresponding parts throughout the figures, and components in the figures are not necessarily to scale.

It will be appreciated that the drawings are provided for illustrative purposes and that the invention is not limited to the illustrated embodiment. For clarity and in order to emphasize certain features, not all of the drawings depict all of the features that might be included with the depicted embodiment. The invention also encompasses embodiments that combine features illustrated in multiple different drawings; embodiments that omit, modify, or replace some of the features depicted; and embodiments that include features not illustrated in the drawings. Therefore, it should be understood that there is no restrictive one-to-one correspondence between any given embodiment of the invention and any of the drawings

FIG. 57 illustrates a latch hub cam variant that incurs lost motion.

FIG. 58 illustrates the latch hub cam of FIG. 57 mounted in a retractable latch.

FIG. 59 illustrates the latch hub cam of FIG. 57 rotated to adapt to an oppositely-handed door.

FIG. 60 illustrates the latch hub cam of FIG. 59 mounted in a retractable latch.

DETAILED DESCRIPTION

Any reference to "invention" within this document is a reference to an embodiment of a family of inventions, with no single embodiment including features that are necessarily included in all embodiments, unless otherwise stated. Furthermore, although there may be references to "advantages" provided by some embodiments, other embodiments may not include those same advantages, or may include different advantages. Any advantages described herein are not to be construed as limiting to any of the claims.

Specific quantities, dimensions, spatial characteristics, compositional characteristics and performance characteristics may be used explicitly or implicitly herein, but such specific quantities are presented as examples only and are approximate values unless otherwise indicated. Discussions and depictions pertaining to these, if present, are presented as examples only and do not limit the applicability of other characteristics, unless otherwise indicated.

Figure 1:
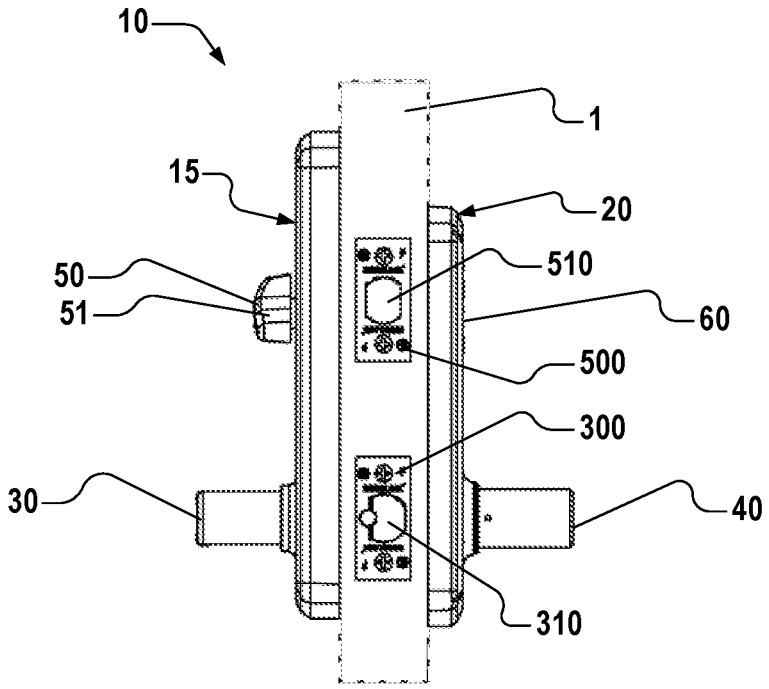
FIG. 1 illustrates a double latch lockset.
Figure 2:
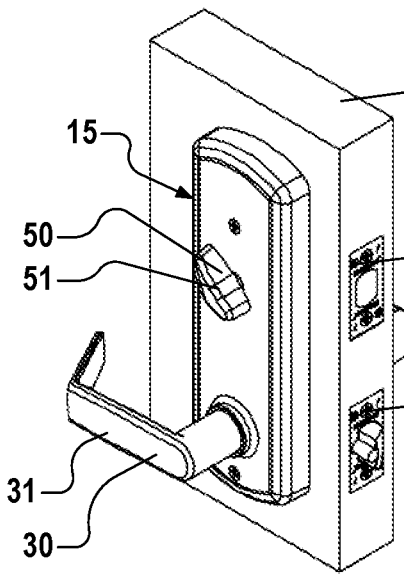
FIGS. 2 and 3 illustrate the double latch lockset of FIG. 1 with an electronic deadbolt actuator.
Figure 3:
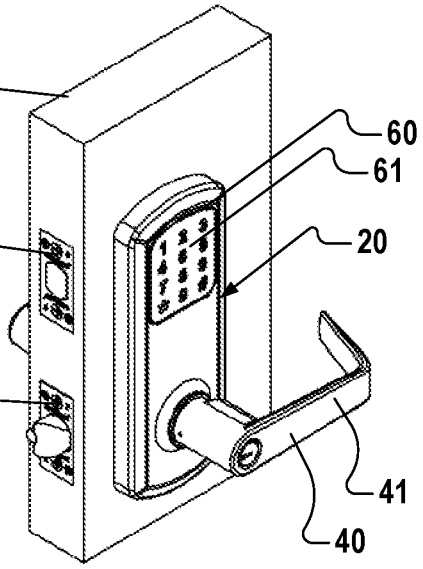
Figure 4:
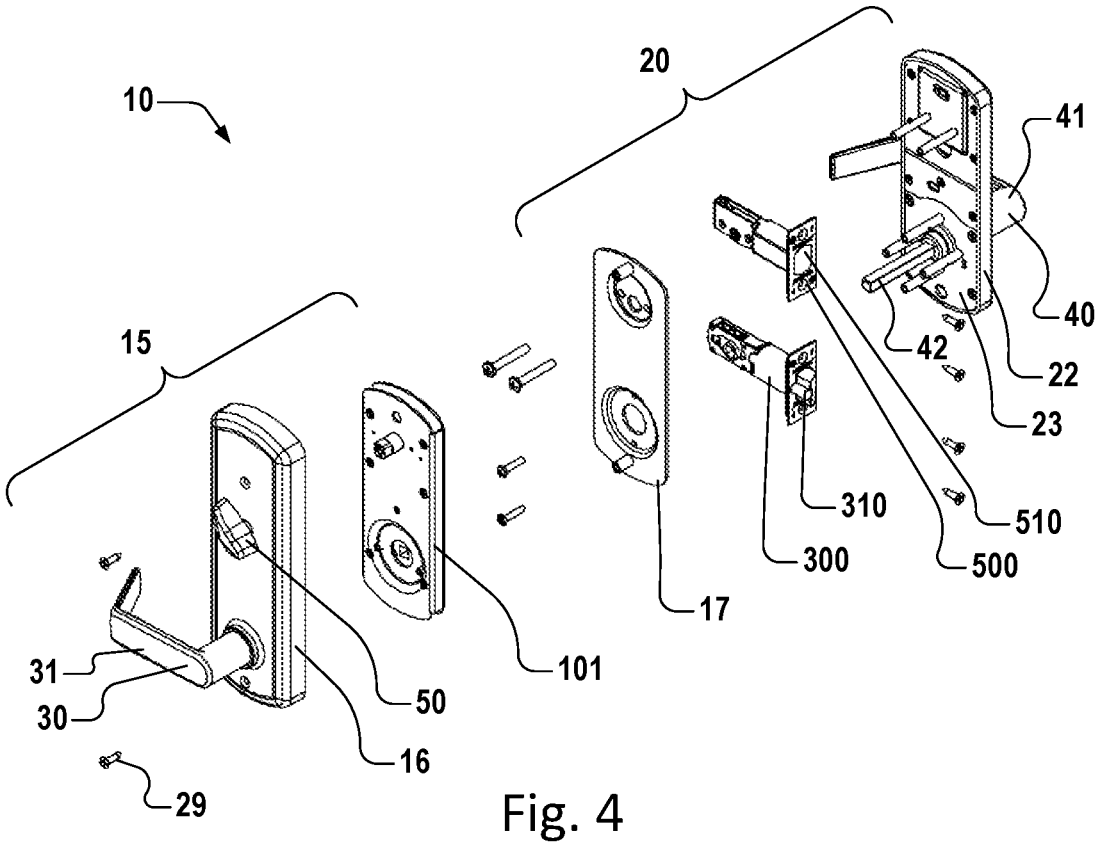
FIG. 4 is an exploded view of the double latch lockset of FIG. 2.
Figure 5:
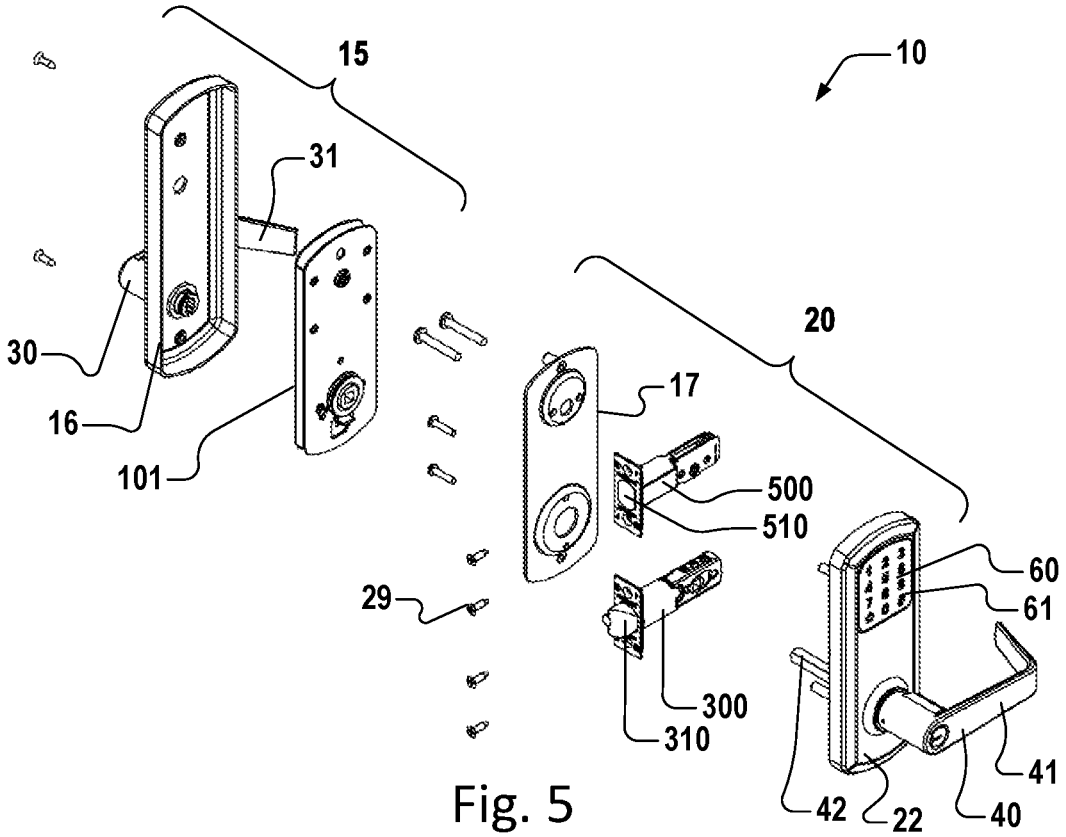
FIG. 5 is an exploded view of the double latch lockset of FIG. 3.
Figure 6:
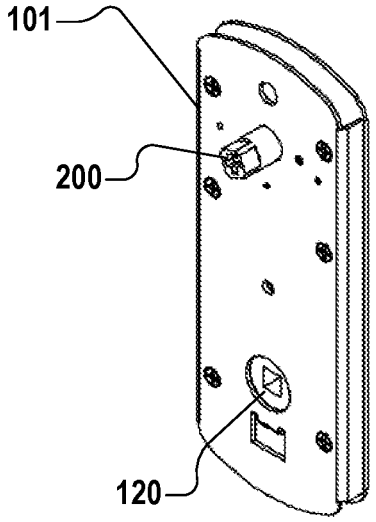
FIG. 6 is a front perspective view of a cartridge.
Figure 61:
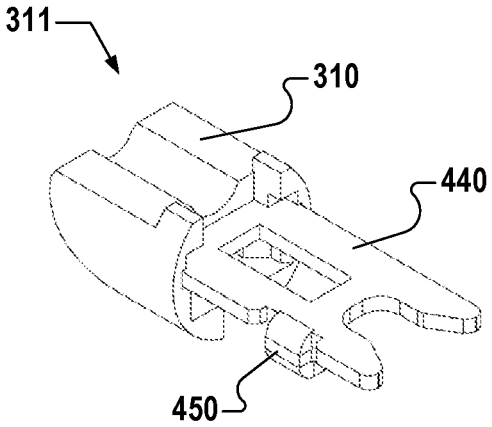
FIG. 61 is a top perspective view of a latch bolt with tail.
Figure 62:
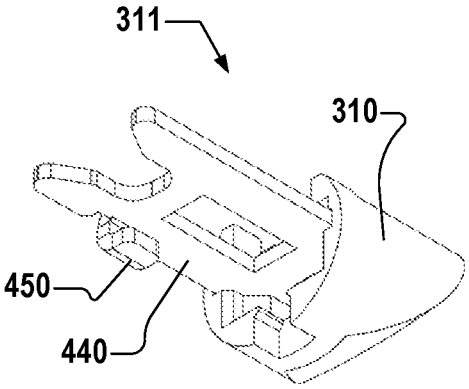
FIG. 62 is a bottom perspective view of a latch bolt with tail.
Figure 63:
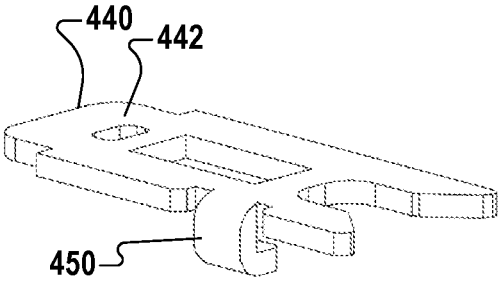
FIG. 63 is a perspective view of the latch bolt tail.
Figure 64:
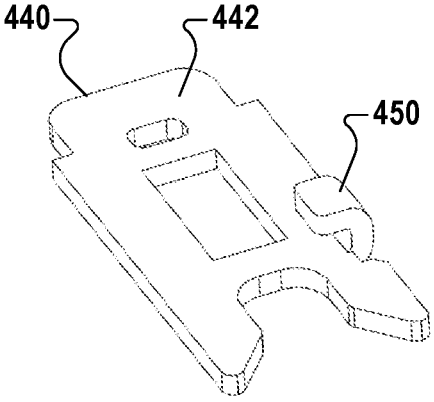
FIG. 64 is an oppositely sided perspective view of the latch bolt tail.
Figure 65:
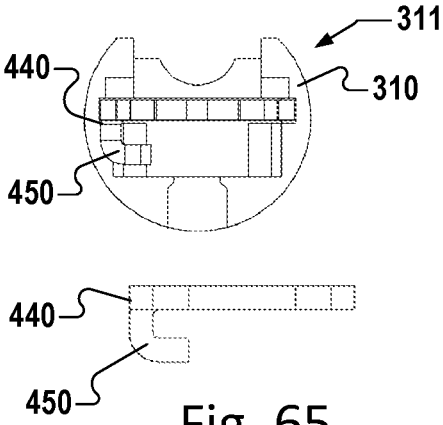
FIG. 65 is an end view of the bolt tail.
Figure 66:
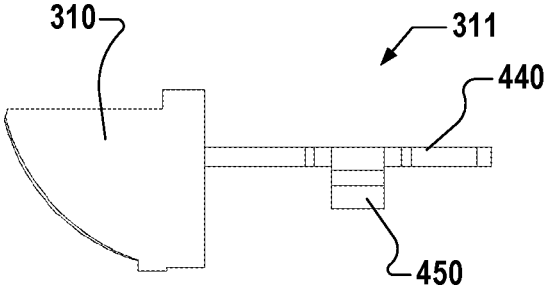
FIG. 66 is a side view of the latch bolt with tail.

In describing preferred and alternate embodiments of the technology described herein, as illustrated in FIGS. 1-61, specific terminology is employed for the sake of clarity. The technology described herein, however, is not intended to be limited to the specific terminology so selected, and it is to be understood that each specific element includes all technical equivalents that operate in a similar manner to accomplish similar functions.

In this specification, as in common use, the term "latch" may, unless otherwise specified, refer to a single lockset (including its actuators), a latch assembly within a lockset (i.e., a retractable latch or a deadbolt), and/or the bolt component of a latch assembly. "Deadbolt" and "bolt" may likewise have overlapping meanings. Clarity is an objective of this specification; however, clarity is not intended to limit understandable substitutions of terms.

Described below are embodiments of a double latch lockset and kits and methods for making a double latch lockset. Emphasis is placed on interconnectivity between two latches within a lockset, with connecting assemblies providing functionality including simultaneous retraction of two latches, oppositely activated latch projection and/or locking, and other improvements on double latch locksets.

Figure 7:
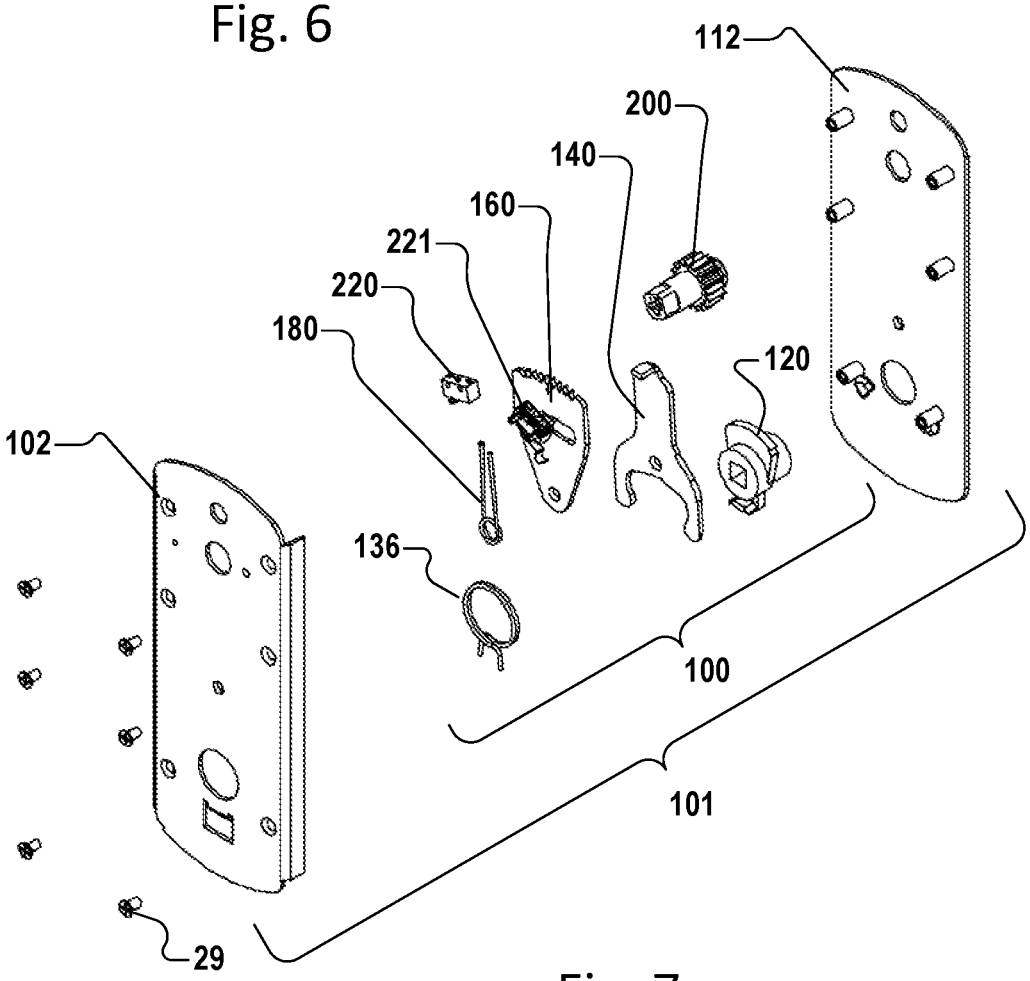
FIG. 7 is an exploded view of the cartridge of FIG. 6, with drive assembly.
Figure 8:
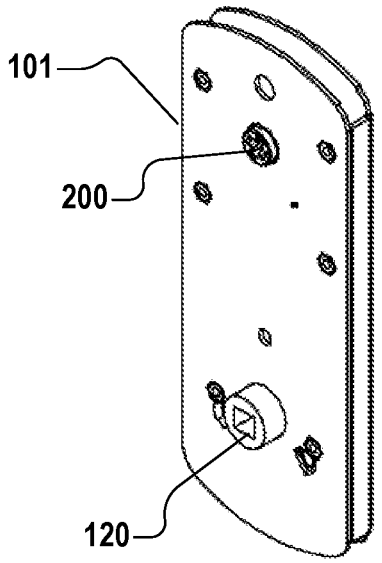
FIG. 8 is a rear perspective view of the cartridge of FIG. 6.
Figure 12:
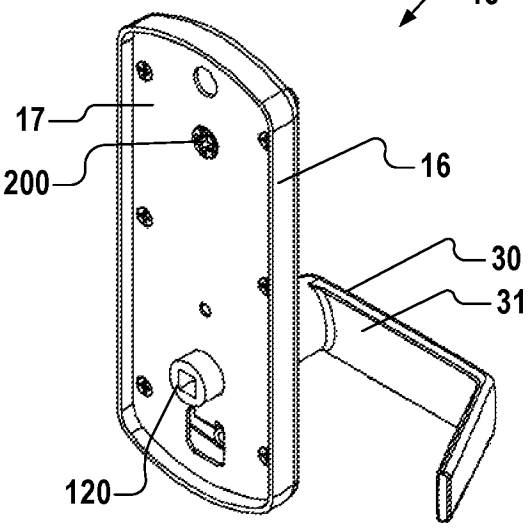
FIG. 12 is a rear view of FIG. 11 as assembled.
Figure 11:
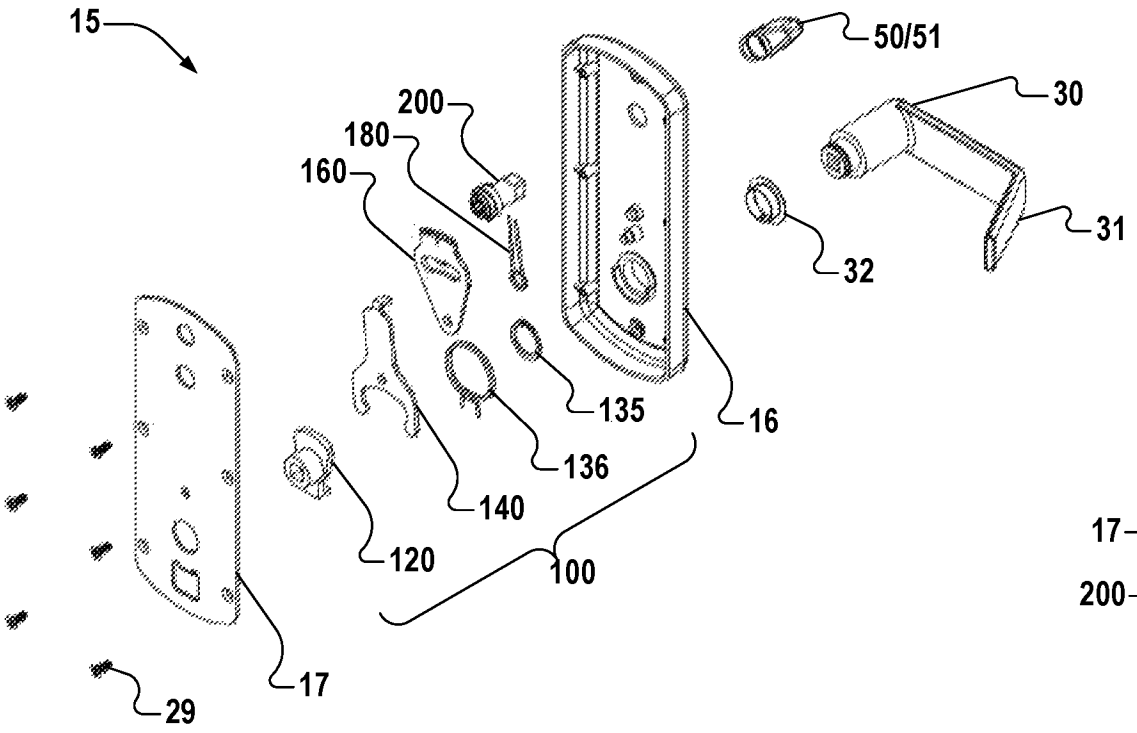
FIG. 11 is an exploded rear perspective view of a drive assembly and other inner trim.
Figure 13:
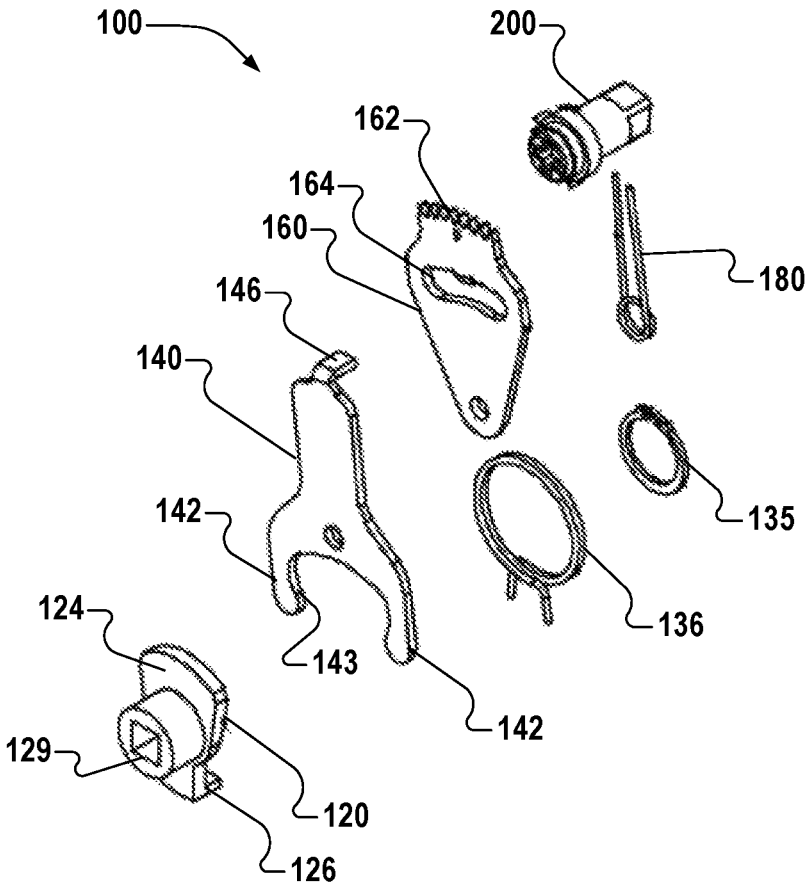
FIG. 13 is an exploded view of the drive assembly of FIG. 11.

FIGS. 1-5 illustrate that such double latch locksets 10 and kits for installation on a door 1 generally include an interior trim 15, an exterior trim 20, a first retractable latch 300, and a second retractable latch 500. The interior trim 15 may include a housing called a cartridge 101 for a drive assembly 100 (FIG. 7)—sandwiched between the interior trim's 15 cover 16 and back plate 17 (FIG. 12)—that connects the first and second latches 300 and 500. Thus the drive assembly 100 may also be called a connecting assembly, transmission assembly, or a transfer assembly. The outer trim 20 may include an outer cover 22 and a back plate 23. A tailpiece 42 may be configured to extend from the first exterior handle 40 to the first interior handle 30 and be operable to act on the first retractable latch 300. The tailpiece 42 may be called a spindle.

The first retractable latch 300 may be a lower latch having a latch bolt 310 and may be activated by a first inside actuator 30 and/or a first outside actuator 40. The first inside and outside actuators 30, 40 may be handles 31, which may be knobs, levers 31, or other actuators. In this specification, handle and lever 31 are used interchangeably, as a lever 31 makes understanding of the product's functionality more straightforward. However, movement of the first inside and outside actuators 30, 40 may be rotary or linear. Reference to movement in a first direction and a second direction are presented generally and as examples unless otherwise explicitly limited. (For example, moving a lever 31 up on the inside will also move the outside lever 31 up. Likewise, moving a knob counterclockwise inside will move a knob outside clockwise. In either case, the lever or knob's movement moves in a first or second direction.) It should be noted that knobs or levers 31 are a mechanical extension of the first and second inside actuators 30, 40, and therefore can be characterized as a component of those actuators.

The second retractable latch 500 may be an upper latch having a latch bolt 510. The latch 500 and the latch bolt 510 may be referred to as a deadbolt 500 or 510. To aid the reader, this specification may refer to the second retractable latch 500 and first retractable latch 300 using the more familiar terms "deadbolt" and "lower latch," respectively. However, it is understood that these colloquial terms are intended to represent the retractable latches' broader meanings. Furthermore, unless otherwise specified, either latch 500, 300 may be in either position, upper or lower. The deadbolt 500 may be activated by a second inside actuator 50, often a thumb turn 51, and/or a second outside actuator 60, which may be a key turn or an electronic keypad 61. Actuators are not limited to those illustrated.

Almost the sole focus of prior art was to provide a quick exit to people in a panic by allowing them, from inside their room, to move a lower handle in either direction in order to simultaneously retract both latches on their door. Moving a lower lever up or down would retract both the lower latch and the deadbolt.

A purpose of the improvements embodied in the present invention(s) is to improve the convenience, efficiency, safety, and other functionality of the double latch lockset 10. The present invention not only allows easy unlocking and exit, but also provides easier locking. At the same time, safer locking is achieved by ensuring the closed position of the latch bolts 310, 510 within a door jamb 3.

In general practice, a user may move a first inside and/or outside actuator 30, 40 in a first direction in order to simultaneously retract both retractable latches 300, 500. (For example, moving a lever 30, 40 down retracts both.) Or a user may move a first inside and/or outside actuator 30, 40 in a second direction in order to project or lock the second retractable latch 500. For reasons of safety and functionality, the first retractable latch 300, after being spring-loaded into a projected position into the door jamb 3 as soon as the door was closed, remains projected during movement of the first inside and/or outside actuators in the second direction. (For example, moving the lever 30, 40 up projects the deadbolt 500, yet the lower retractable latch 300 remains projected. The steadfastness of the lower retractable latch 300 assures that during locking a warped door or molding does not push the door 1 open.) Thus, actuation of the first inside and/or outside actuator 30, 40 in a first direction produces an action on both the first and second retractable latches 300, 500; however, actuation of the first inside and/or outside actuator 30, 40 in a second direction produces only a single action on the opposite (second) retractable latch 500.

Although the first and second retractable latches 300, 500 are connected, actuation of the second retractable latch 500, whether from inside or outside, does not open the first retractable latch 300. (For example, an interior thumb turn 51, exterior key turn, or keypad 61 may be actuated to unlock a deadbolt 500, but the lower retractable latch 300 remains projected into the door jamb 3.) Thus, the second inside and outside actuators 50, 60 retract only the second retractable latch 500.

Turning to the specifics of the drive assembly 100, FIGS. 6-15 discuss a basic preferred embodiment and its variations. A housing or cartridge 101 comprises a front plate 102 and a back plate 112, as well as screws 29 or another form of attachment to hold the plates 102 and 112 together. The cartridge 101 also houses a drive cam 120, a second latch (deadbolt) trigger 200, and a transmission that asymmetrically couples the drive cam 120 to the deadbolt trigger 200. The transmission comprises a first reactor plate 140 and a second reactor plate 160 that are configured to transmit motion of the drive cam to the deadbolt trigger 200 to cause the first and second retractable latches 300 and 500 to retract at about the same time (i.e., in tandem), while preventing a transmission of sufficient motion of the deadbolt trigger 200 to the drive cam 120 to retract the first retractable latch.

The drive cam 120 has an aperture 129 configured to be acted upon by the tailpiece 42 of the first inside and/or outside actuators 30 and 40. The drive cam 120 comprises a flange 124 that is configured to fit partially within opposing arms 142 of a first reactor plate 140 and to rotate, its cam tab 126 subject to restriction by a torsion spring 136 configured to cooperate with a spring stop 106 on the front plate 102, and act upon an inner surface 143 of either of the two opposing arms 142. The first reactor plate 140 is configured to act in turn upon a second reactor plate 160 via a first pivot point 168 (proximate the overlap of the first and second reactor plate bodies 140, 160) and a second pivot point at a pivot tab 146, the latter of which passes through an arcuate opening 164 in the second reactor plate 160 near a reactor tab 166 on the second reactor plate 160, both the pivot tab 146 and reactor tab 166 engaging an escapement spring 180 designed to resist over-rotation of the second reactor plate 160, thus making a deadbolt 500 harder to break (see FIGS. 20-21). The first pivot point 168 and the pivot tab 146 together may be referred to as "two pivot points," the term "point" referring to a proximate area rather than a discrete point.

Characterized in another way, the drive cam 120 is configured when rotating in a clockwise direction to drive the first reactor plate 140 to rotate in a counterclockwise direction about a pivot point 168, and when rotating in a counterclockwise direction to drive the first reactor plate 140 to rotate in a clockwise direction. A coupling between the first and second reactor plates 140 and 160 configures the first and second reactor plates 140, 160 to move substantially in unison to operate the deadbolt 500 unless movement of either the first or second reactor plates 140, 160 is blocked relative to the other.

The second reactor plate 160 is configured in turn to act upon a deadbolt trigger 200 that is configured to retract or project a second retractable latch 500. The part and term "deadbolt trigger" is not limited to use with a deadbolt 500, but may be used with a second retractable latch 500 in general (i.e., a "latch trigger"). The second reactor plate 160 may be referred to as a follower plate or multiplier and may comprise a rack 162 configured to coact with a deadbolt trigger 200 that comprises a gear having teeth 202. However, the second reactor plate 160 may not be a rack 162 and may still be configured to coact with a deadbolt trigger 200 that comprises an arm, and said arm may be rotatable.

Sensors 220, 221 may be included to detect the position of the second reactor plate 160, thereby deducing the position of the bolt 510 of the second retractable latch 500. Electronics and sensors in general may be complex or simple, and they may pertain to one or both latches 300, 500 and to the drive assembly 100. However, the double latch lockset 10 may also be fully mechanical with no electronics or sensors.

Figure 9:
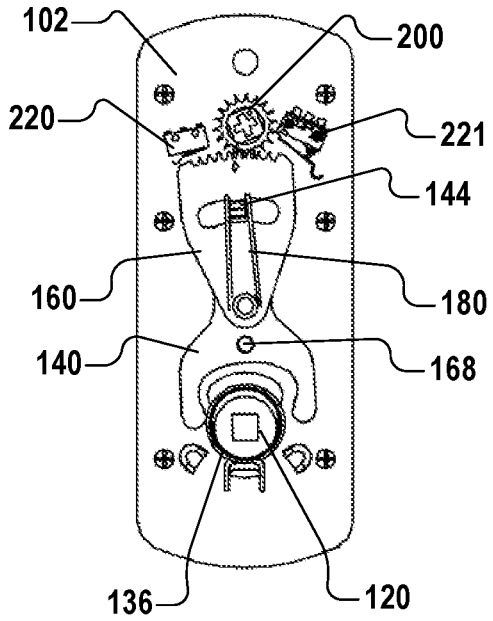
FIG. 9 is a rear view of an assembled drive assembly.
Figure 10:
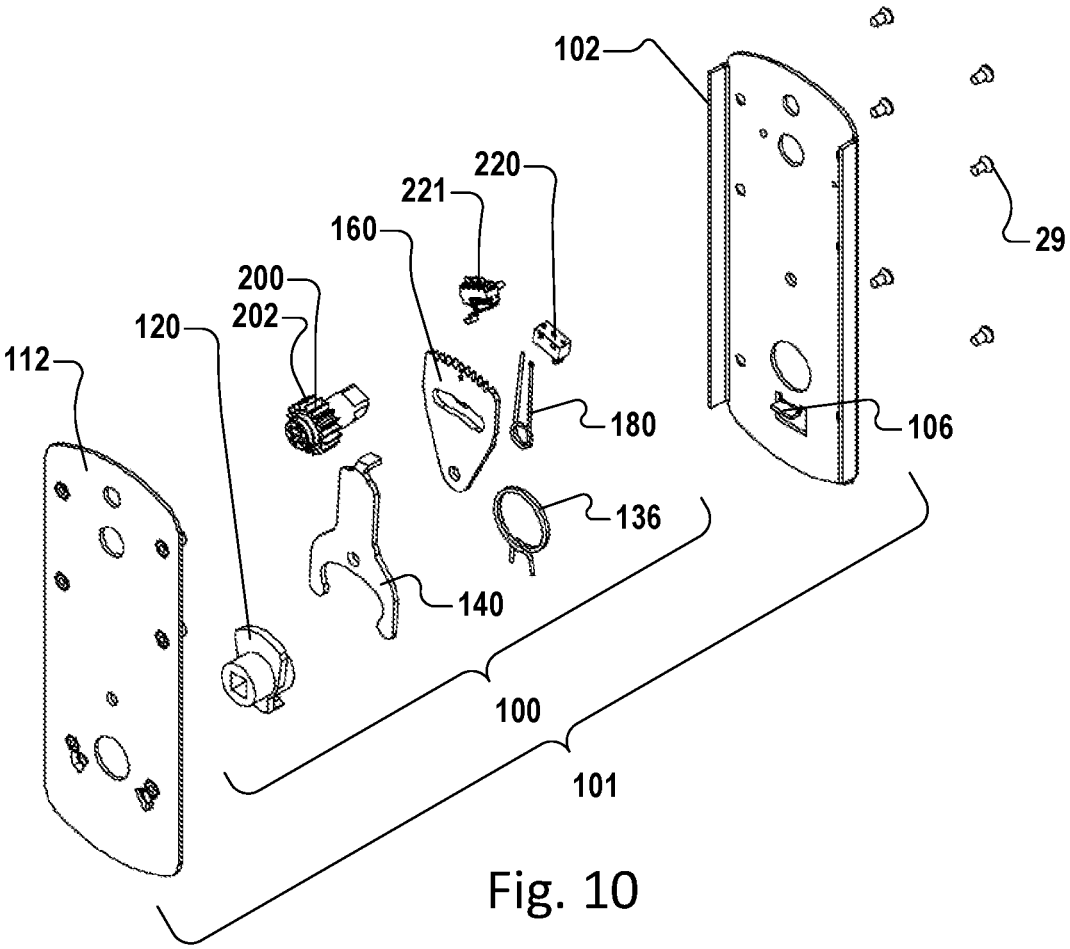
FIG. 10 is an exploded view of the cartridge of FIG. 8, with drive assembly.
Figure 22:
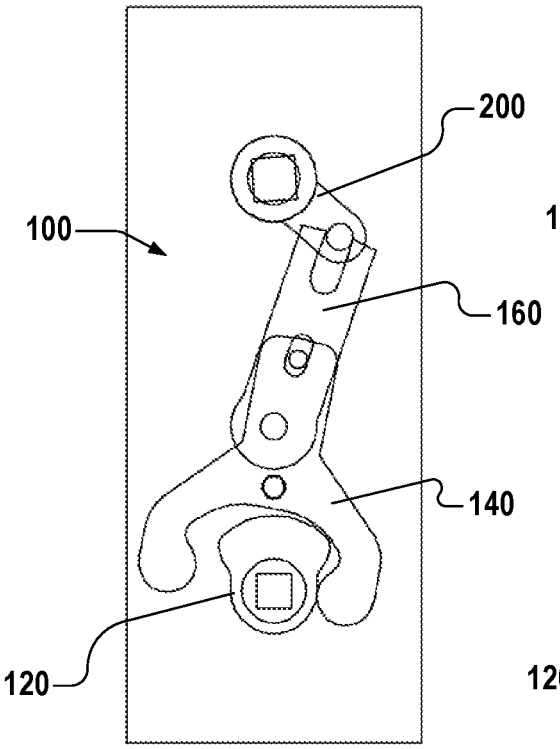
FIGS. 22-24 illustrate alternate embodiments of the drive assembly of FIG. 9.
Figure 23:
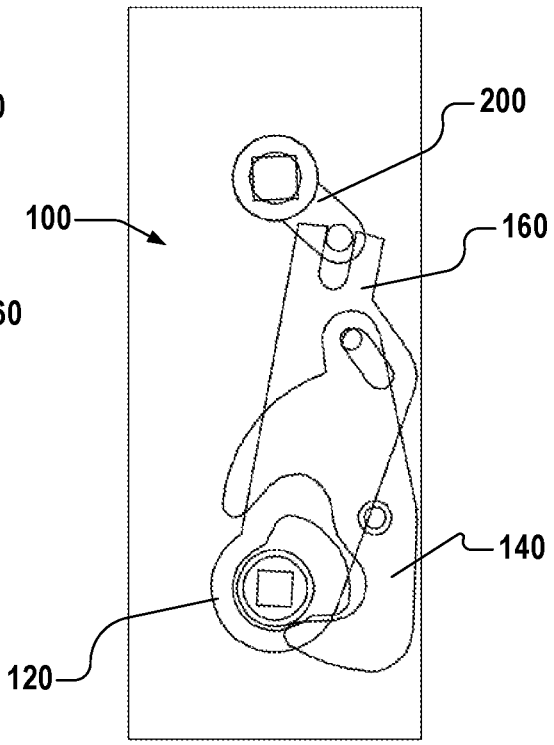
Figure 24:
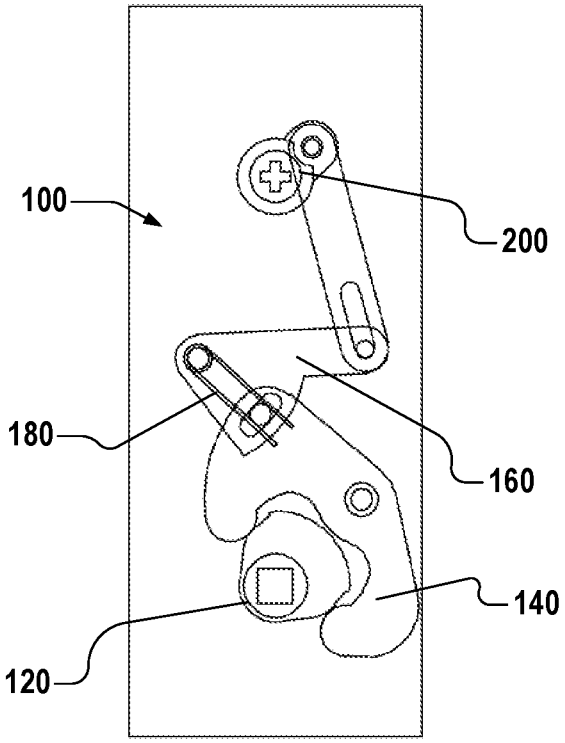
Figure 25:
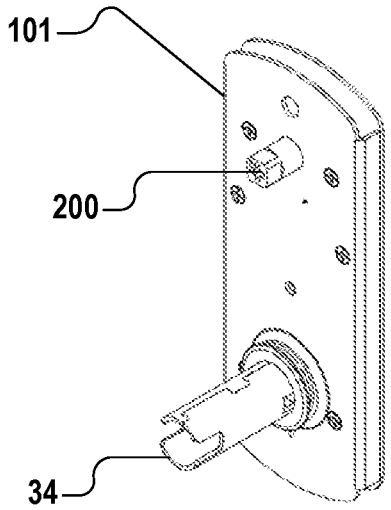
FIG. 25 is a front perspective view of a cartridge.
Figure 26:
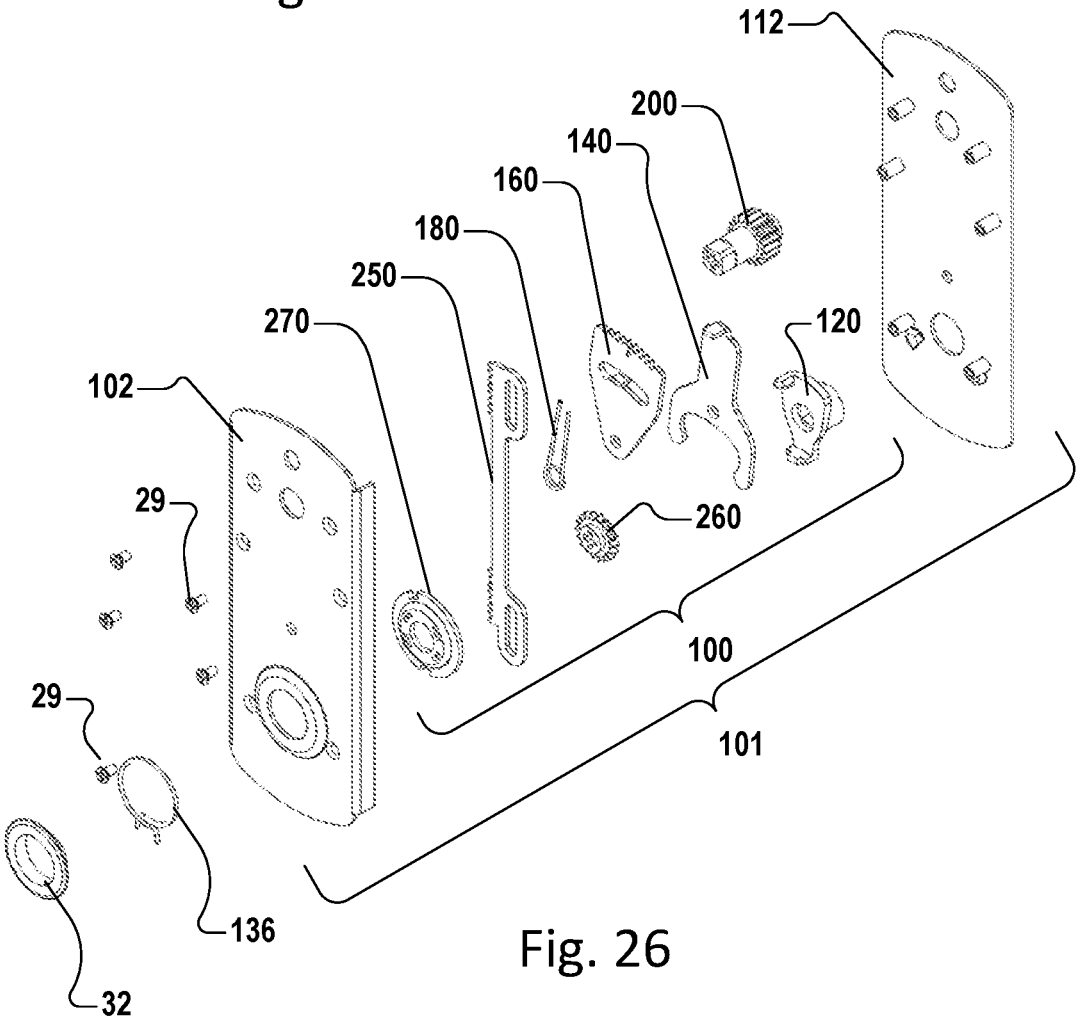
FIG. 26 is an exploded view of the cartridge of FIG. 25, with drive assembly.
Figure 27:
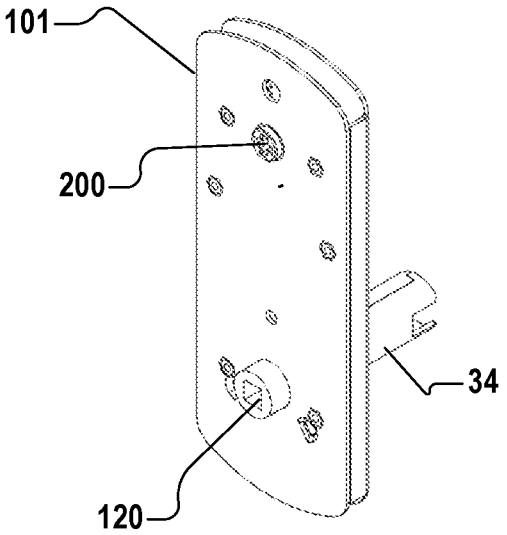
FIG. 27 is a rear perspective view of the cartridge of FIG. 25.
Figure 28:
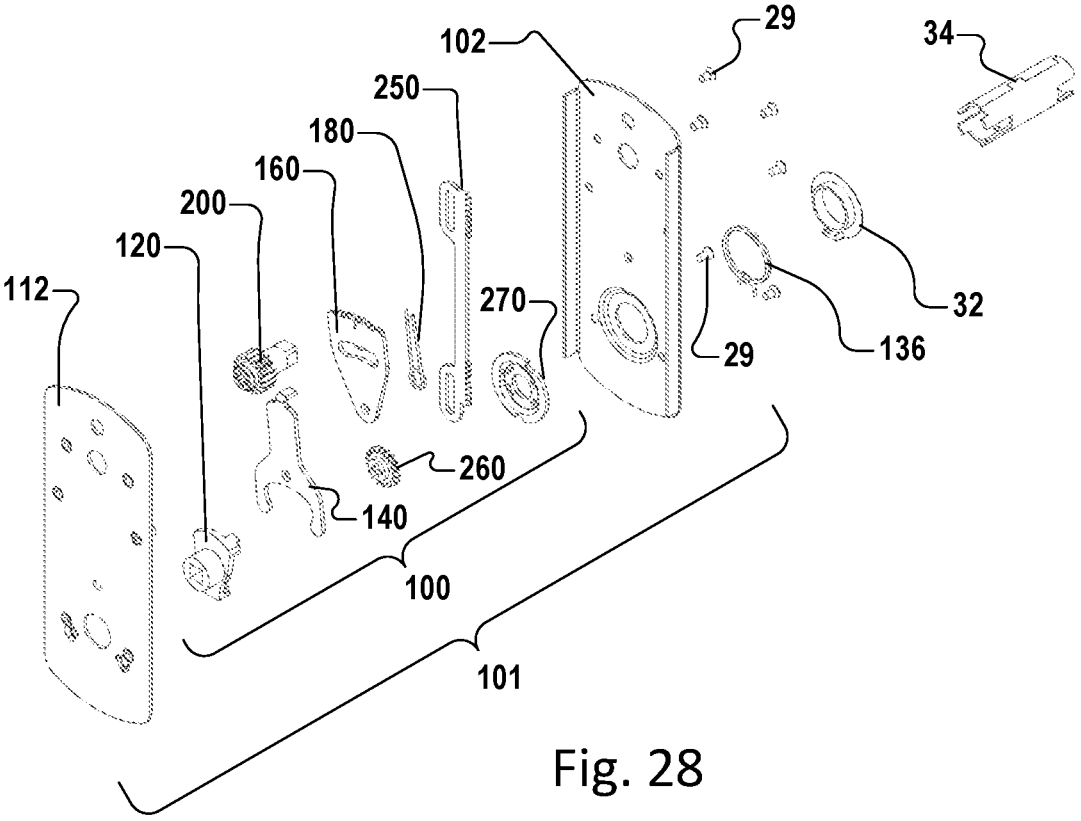
FIG. 28 is an exploded view of the cartridge of FIG. 27, with drive assembly.
Figure 29:
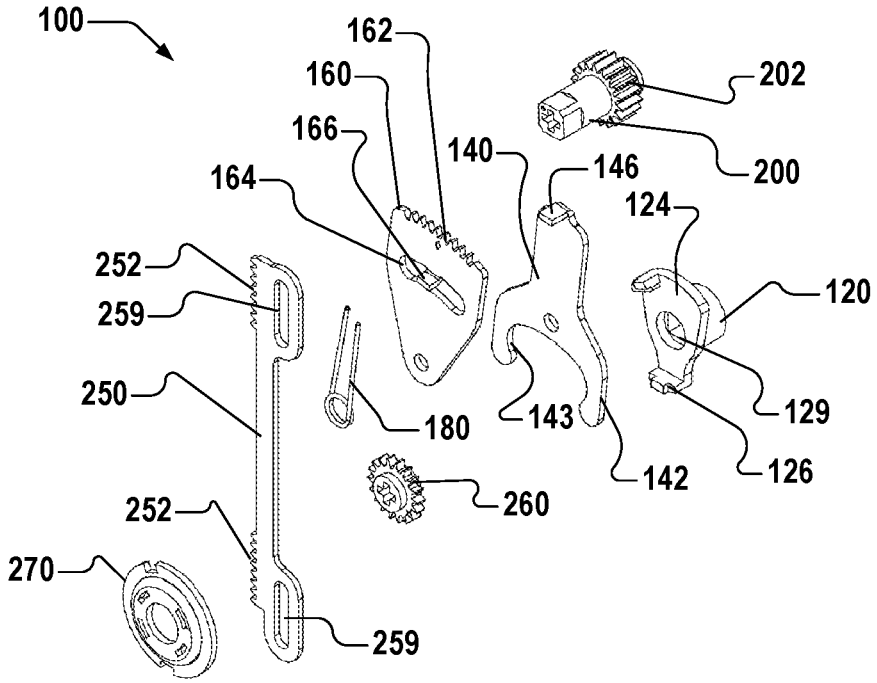
FIG. 29 is an exploded front perspective view of a drive assembly.
Figure 30:
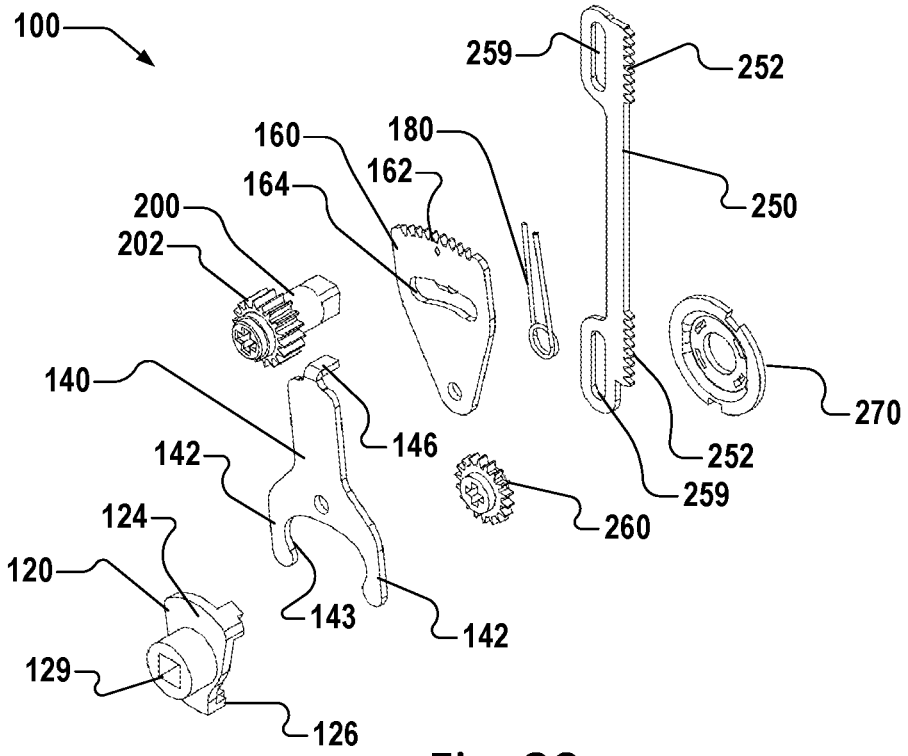
FIG. 30 is a rear exploded view of the drive assembly of FIG. 29.

FIG. 9 provides a nice view of the relationship among the parts of a drive assembly 100. As stated previously, the deadbolt trigger 200 does not act in reverse order upon the drive cam 120, as the torsion spring 136 returns the drive cam 120 to its neutral position and the first reactor plate's 140 arms 142 are configured to avoid such reverse action. Alternatively, FIGS. 22-24 show three varied configurations that allow similar relationships among the parts of a drive assembly 100. In each, a drive cam 120 acts upon a first reactor plate 140, which acts upon a second reactor plate 160 (which may or may not cooperate with an escapement spring), which acts upon a deadbolt trigger 200 that comprises an arm.

Figure 14:
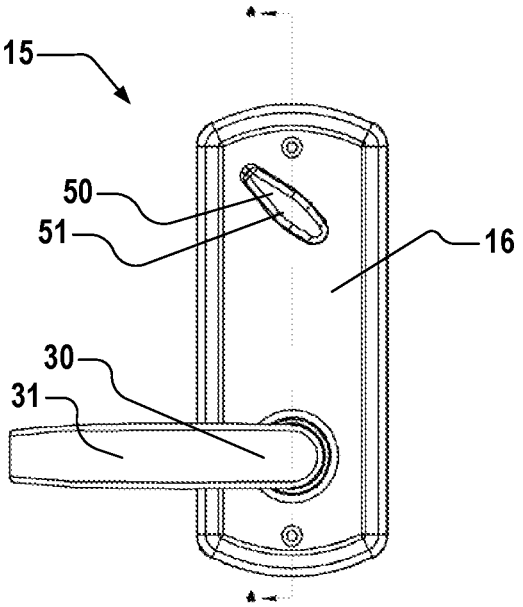
FIG. 14 is a front view the inner trim of FIG. 12, as seen from inside a room.
Figure 15:
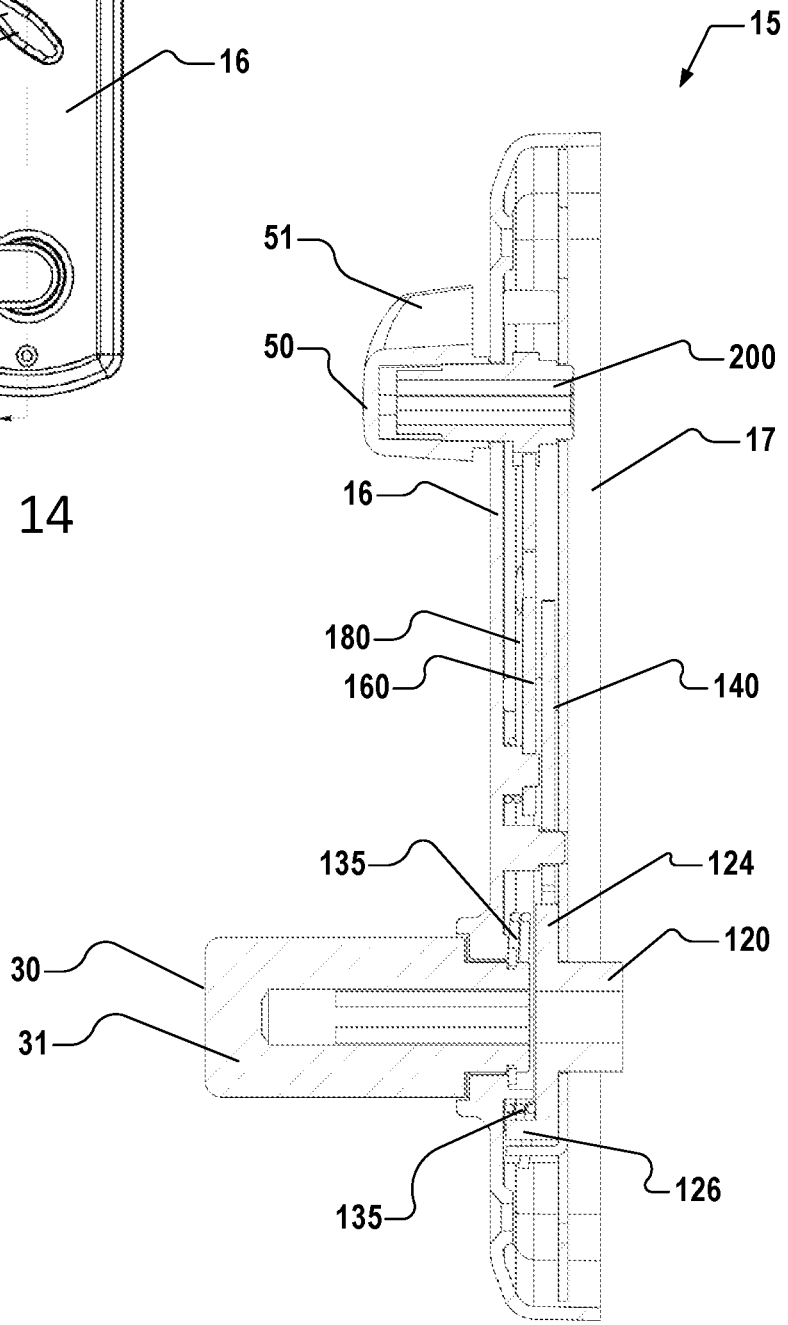
FIG. 15 is a side view cross-section of the inner trim of FIG. 14 comprising a drive assembly.

FIGS. 11-15 illustrate a variation on the drive assembly 100. The main difference is that the parts are mounted on the inner cover 16 or back plate 17 of the inner trim 15 without use of a separate cartridge 101 housing. In any configuration, retaining rings 135 and bushings 32 may be used as needed to secure parts. FIG. 15 shows how parts of a drive assembly 100 may be fitted together or stacked one upon another in a relatively narrow space. Achieving the described functionality and structure in a limited, slim space is of significant value to the invention, as the resultant product must meet user expectations in the market. Those expectations include an attractive finish, for example as seen in FIG. 14, and an ability to install the lockset 10 in standard doors that already have latch holes.

Shown in cross-section in FIG. 15, the inner trim 15 comprises inner cover 16 and back plate 17 sandwiching the parts. At the lower, first inside actuator 30, the torsion spring 136 holds the drive cam 120 in place and aligned with the first reactor plate 140, which stacks against the second reactor plate 160 and cooperates with escapement spring 180. The second reactor plate 160 is aligned with the deadbolt trigger 200 of the upper, second inside actuator 50.

Figure 16:
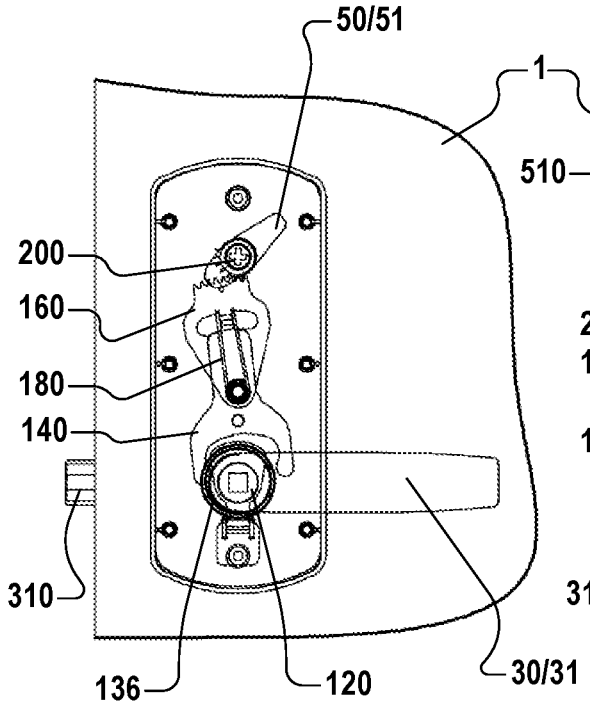
FIG. 16 illustrates the drive assembly of FIGS. 13-14 when the lockset's lower latch and deadbolt are in normal unlocked position, with the deadbolt retracted.
Figure 17:
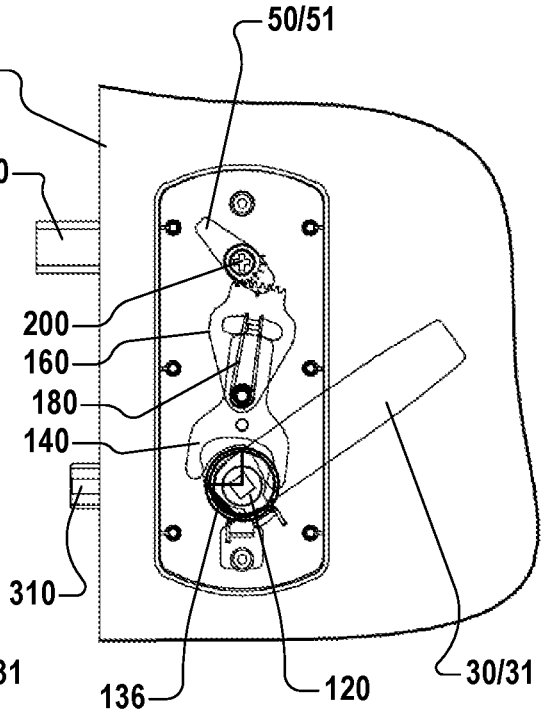
FIG. 17 illustrates the drive assembly of FIGS. 13-14 when the lockset's lower lever is up, with the lower latch retaining its position and the deadbolt projected.

Returning now to the drive assembly 100 parts as arranged in FIG. 9, FIGS. 16-21 illustrate movement of the parts of the lockset 10 as the first inside and/or outside actuator 30, 31 is moved. For ease of discussion, the first actuator 30, 31 moving in a first or second direction is shown by a lever 30/31 moving down or up. (Of course, the first and second direction may alternatively be described as moving up or down.) FIG. 16 shows the door 1 in a normal unlocked position with deadbolt 510 retracted and first retractable latch 310 projected. FIG. 17 shows the lever 30/31 moved up, causing the drive cam 120 to act on an arm 142 of the first reactor plate 140, which acts through the second reactor plate 160 to turn the deadbolt trigger 200, thus also turning the thumb turn 50/51 (second inside actuator) and projecting the deadbolt 510. Very importantly, the first latch bolt 310 does not retract during this movement, thus keeping the door 1 closed and keeping the deadbolt 510 aligned with its related jamb recess 4.

Figure 18:
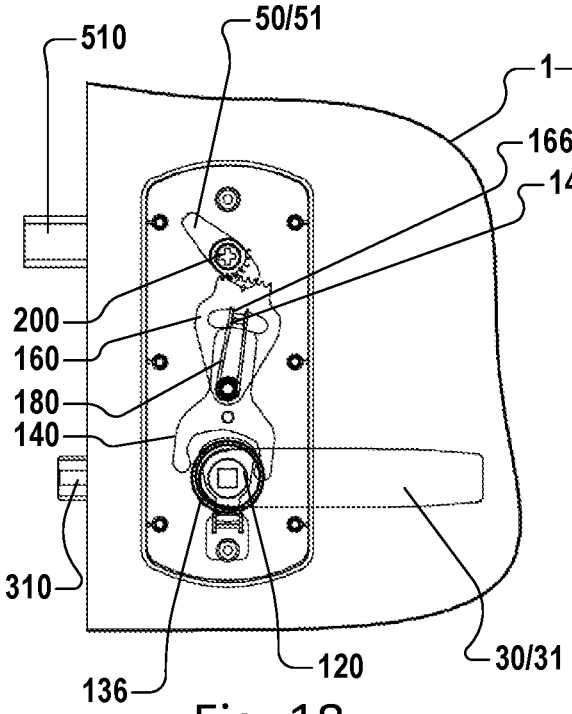
FIG. 18 illustrates the drive assembly of FIGS. 13-14 when the lockset's lower latch and deadbolt are in normal locked position.
Figure 19:
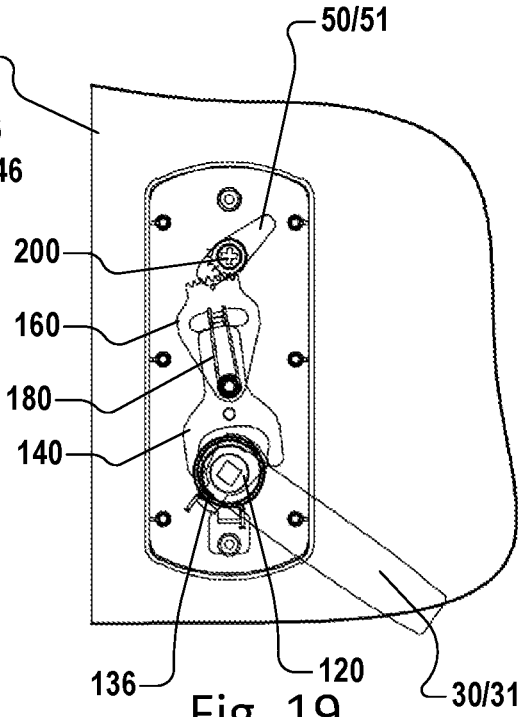
FIG. 19 illustrates the drive assembly of FIGS. 13-14 when the lockset's lower lever is down and both the latch and deadbolt are retracted

FIG. 18 shows the door 1 in a normal locked position with both the first and second latches 300 and 500 extended. The only difference from FIG. 17 is that the torsion spring 136 returned the lever 31 to its normal state. (Note that if the deadbolt thumb turn 50/51 in FIG. 18 is turned to unlock the deadbolt 510, the arm 142 shown on the left side of the first reactor plate 140 will return to the position shown in FIG. 16, and it does not act on the flange 124 of the drive cam 120 or affect the lower latch 300.) FIG. 19 shows the lever 30/31 pulled down and retracting both the first and second latches 310, 510. The lever 31 causes the drive cam 120 to act on the opposite arm of the first reactor plate 140, thus acting through the second reactor plate 160 to turn the deadbolt trigger 200, rotate the thumb turn 50/51, and retract the deadbolt 510.

FIGS. 16-19 demonstrate that after the drive cam 120 acts upon the first reactor plate 140 to either project or retract the deadbolt 510, the torsion spring 136 drives the cam 120 back to its default, neutral position. Meanwhile, the first reactor plate 140 comes to rest tilted in the opposite orientation that it has prior to the action. This is illustrated by the contrasting orientations of the first reactor plate in FIGS. 16 and 18. This toggling action positions the arm 142 that had been acted upon away from the drive cam flange 124, and the opposite arm 142 near to the drive cam flange 124. This not only enables the drive cam flange 124 to drive the reactor plate 140 in the opposite direction, but also prevents direct action on the thumb turn 50/51 from acting on the drive cam 120 in reverse.

For example, FIG. 19 illustrates retraction of both latch bolts 310, 510 as the drive cam 120 rotates clockwise to push the arm 142 on the right side, and then the drive cam 120 with latch bolt 310 and the lever 31 return counterclockwise to rest (aided by both the torsion spring 136 and the spring mechanism of the latch 300 itself) as seen in FIG. 16, with the arm 142 on the left side positioned to be acted upon by the drive cam 120 for locking initiated by the drive cam 120. The right-side arm 142 is now out of range of the drive cam flange 124 such that the right arm 142 cannot act upon the drive cam 120 if the deadbolt 200 is projected via the thumb turn 51. FIGS. 22-24 show alternate, but similar, shapes for the drive cam 120 and first reactor plate 140, but in each case the drive cam 120 cannot be driven by the first reactor plate 140.

Figure 20:
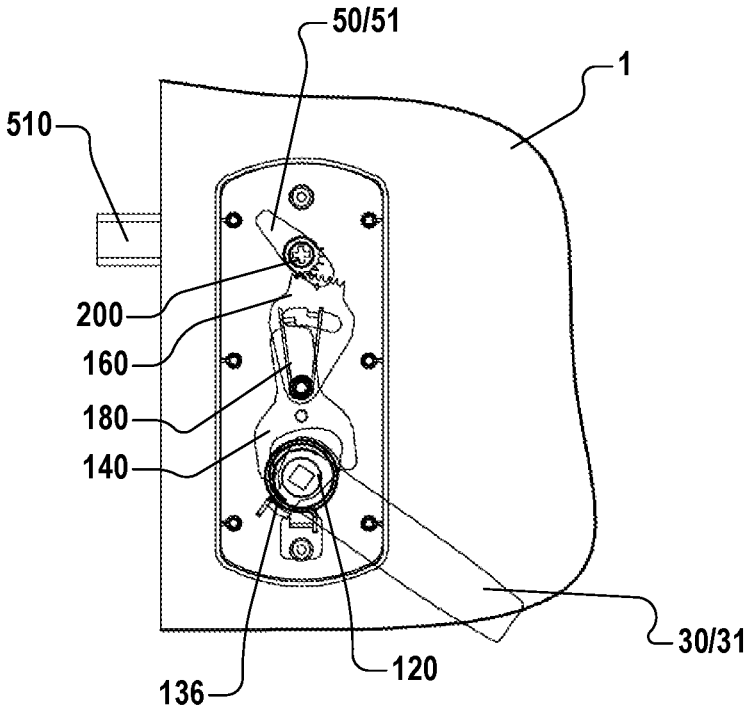
FIG. 20 illustrates the assembly of FIGS. 13-14 with the deadbolt blocked during retraction.
Figure 21:
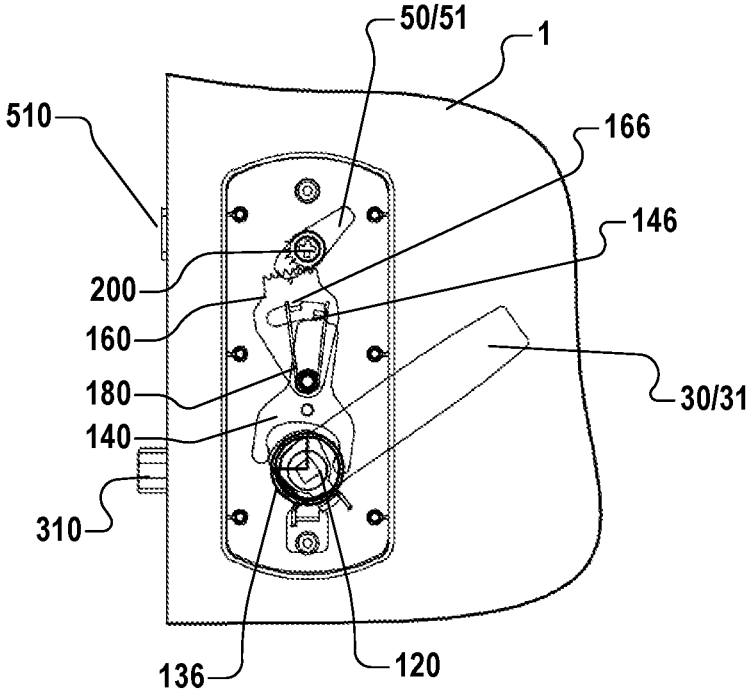
FIG. 21 illustrates the assembly of FIGS. 13-14 with the deadbolt blocked during projection.

FIGS. 20 and 21 illustrate the protection afforded to the deadbolt 500 and the drive assembly 100 by an escapement spring 180. In FIG. 20, if the deadbolt 510 is blocked during retraction/unlocking, a common response might be to turn push the lever 31 down harder and farther (or to act similarly on an upper actuator 50, 60). The escapement spring flexes and widens, allowing the first reactor plate 140 with pivot tab 146 to move relative to the second reactor plate 160 and its reactor tab 166 without breaking the first or second latch 300, 500. In FIG. 21, if the deadbolt 510 is blocked during projection/locking, a common response might be to push the lever 31 harder and farther up or to turn the thumb turn 51 harder and farther. The escapement spring flexes and widens, allowing the second reactor plate 160 with reactor tab 166 to move relative to the first reactor plate 140 and its pivot tab 146. In this way, the thumb turn 51 and its associated second inside actuator 50 has room to give without breaking the second inside actuator 50.

Figure 31:
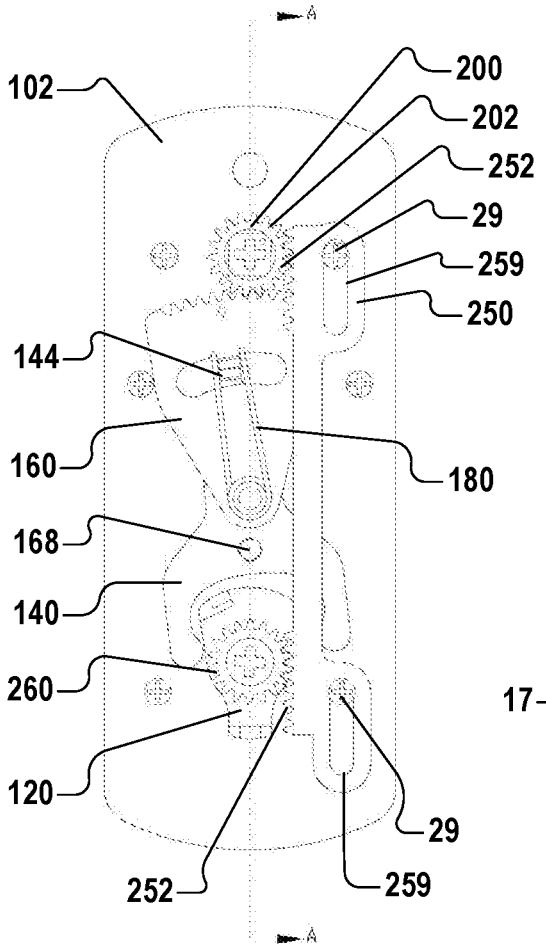
FIG. 31 is a rear view of an assembled drive assembly.

An enhanced embodiment of a drive assembly 100 is found in FIGS. 25-32. In particular, FIG. 31 illustrates the interaction of the parts and is useful for comparison to the drive assembly of FIG. 9. In an electronic version, the outer lever 41 may be non-operable (either locked, clutched, or disconnected) when the deadbolt 510 is locked and operable when the deadbolt 510 is retracted. The cartridge 101 is altered to house a locking rack 250 configured to enable a second actuator 50, 60 to lock a first outside actuator 40 (for example, the action of "throwing" or locking a deadbolt also locks a first retractable latch 300). As shown, slots 259 on the locking rack 250 permit the locking rack 250 to travel up and down in linear motion while secured by two screws 29 that join the front cartridge plate 102 to the back plate 112. However, the locking rack 250 may be otherwise movably secured and may be arched rather than linear. Opposing each slot 259 may be teeth 252 configured to coact with gears. One gear may be a pinion 260 associated with the drive cam 120, and another gear may be a deadbolt trigger 200 with teeth 202 (an alternate version is configured for a deadbolt trigger 200 that is a rotatable arm). A spindle washer 270 holds the pinion 260 in cooperation with the drive cam 120, and the drive cam 120 is activated via a spindle sheath 34 through the spindle washer 270. In this instance a torsion spring 136 and bushing 32 are located outside of the cartridge 101 proper, though other internally located configurations are possible. Thus, the locking rack 250 is an additional connection between the first and second actuators 30, 40 and 50, 60 that is designed to bind the first outside actuator 40 for additional security when the deadbolt 500 is locked. In practice, moving a first inside and/or outside actuator in a second direction (i.e., lever up) causes the deadbolt 510 to project and also trips the locking rack 250 to lock the lower trim/outside actuator 40. Projecting the deadbolt 510 using the second inside or outside actuator 50, 60 has the same effect. With modification, similar functionality may be achieved for use with a keyed, mechanical deadbolt 510.

Figure 32:
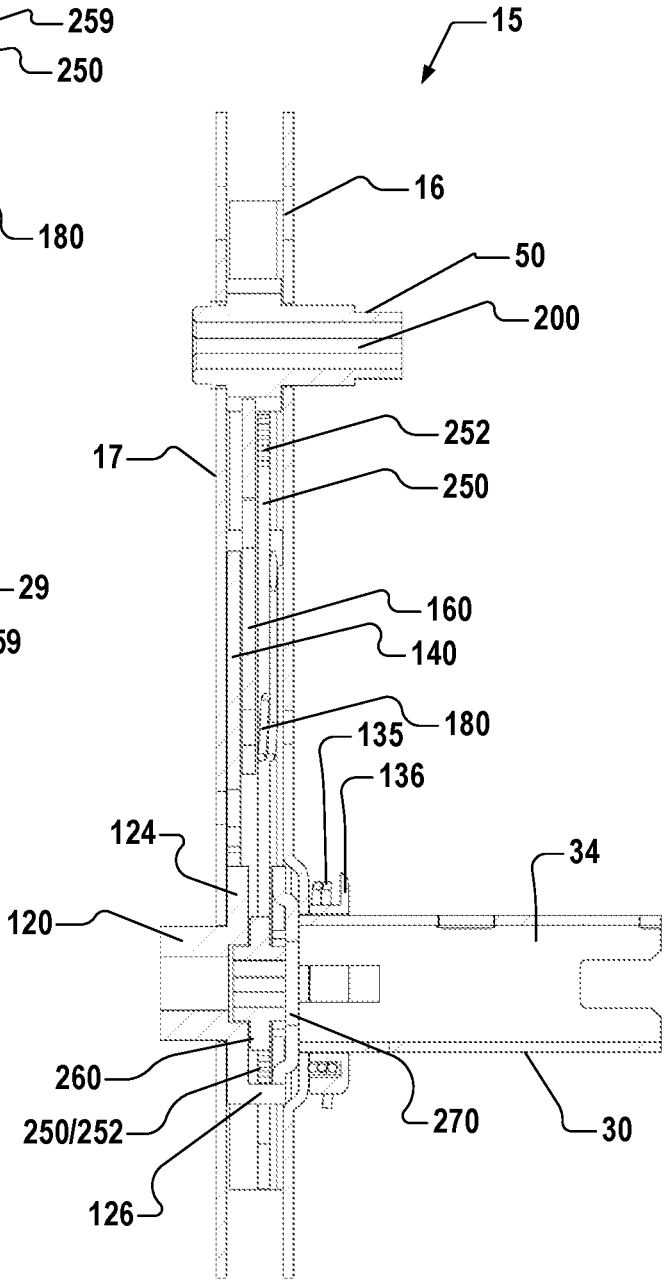
FIG. 32 is a side view cross-section of the drive assembly of FIG. 31.

In cross-section, FIG. 32 shows the inner trim 15 comprising front cover 16 and back plate 17 sandwiching various parts of the drive assembly 100. Pinion 260 is positioned between the drive cam 120 and spindle washer 270 such that the spindle sheath 34 of the first inside actuator 30 may act on the spindle washer 270, which cooperates with the drive cam 120. The pinion 260 is aligned with the locking rack 250 and positioned to coact with a lower set of teeth 252. At the other end of the locking rack 250, the deadbolt trigger 200 is positioned to coact with an upper set of teeth 252. Other parts are "stacked" as described previously, with the torsion spring 136 now located with the spindle sheath 34. As noted earlier, inventing in the confines of this small space often speaks to non-obviousness regarding structure, functionality, and efficiency of parts and motion. One of skill in the art will recognize that prior art, whether alone or in combination, does not achieve the same functionality or efficiency.

Figure 33:
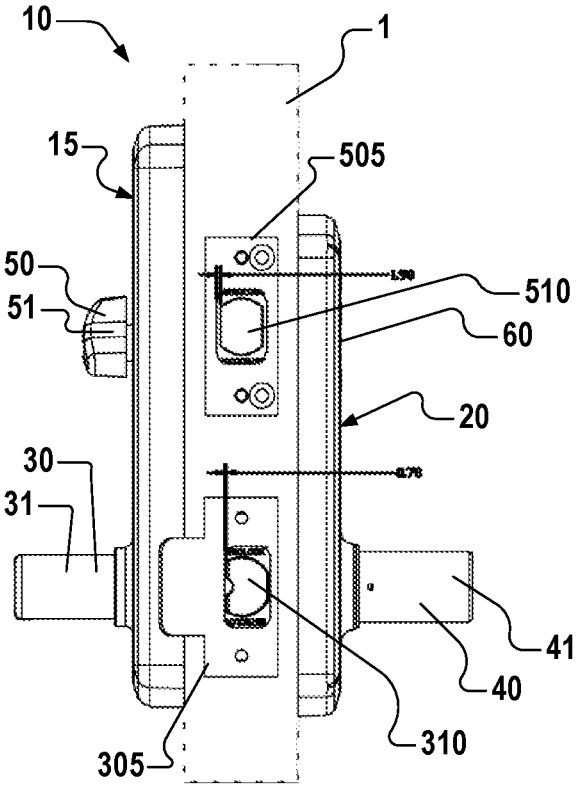
FIG. 33 illustrates latch tolerances the double latch lockset of FIG. 1.
Figure 34:
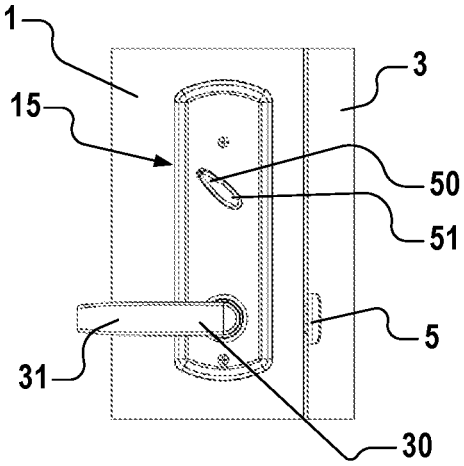
FIG. 34 is a view of interior trim corresponding with a door jamb.
Figure 36:
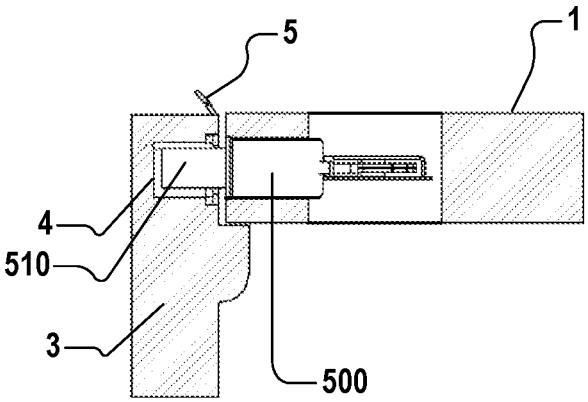
FIG. 36 is a cross-section showing deadbolt tolerance in a door jamb.
Figure 35:
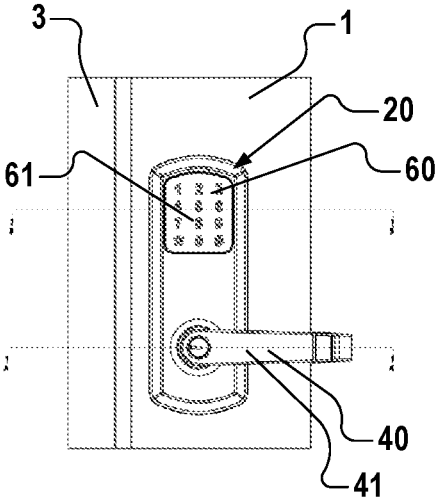
FIG. 35 is a view of exterior trim corresponding with a door jamb.
Figure 37:
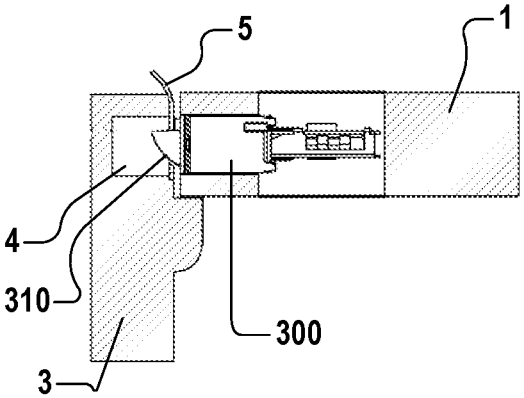
FIG. 37 is a cross-section showing retractable latch tolerance in a door jamb.

FIGS. 33-37 stress the importance of not letting a first retractable latch 300 and its latch bolt 310 retract when a second retractable latch 500 and its latch bolt 510 (typically a deadbolt 510) is projected by movement of a first inside and/or outside actuator 30, 40 in a second direction (to lock the door 1). FIG. 33 illustrates tight clearances of the first and second latch bolts 310, 510 within their respective face plates 305, 505. The deadbolt 510 has a greater clearance than the first retractable latch bolt 310 in order to account for warped doors 1 or other misalignments with the jamb 3. FIGS. 36 and 37 are cross-sections through the latches 500 and 300, respectively. The latch bolts 310 and 510 maintain relatively tight tolerances projecting out of the door 1 and into the strike plates 5 and recesses 4 on the jamb 3. By keeping the first retractable latch bolt 310 in its projected position during locking of the second latch bolt 510 via movement of the first inside and/or outside actuator 30, 40 in a second direction (for example, lever up), the second latch bolt 510 is aided in closure.

To summarize, the double latch lockset may be characterized as a first retractable latch configured to be activated by a first inside and/or outside actuator and a second retractable latch (which may be a deadbolt) configured to be activated by a second inside and/or outside actuator. The second inside or outside actuators may activate the second retractable latch independently of the first retractable latch. When the lockset is assembled, the first and second retractable latches are interconnected. Movement of the first inside and/or outside actuator in a first direction simultaneously retracts both latches. Movement of the first inside and/or outside actuator in a second direction locks (or projects, if a deadbolt) the second retractable latch. The first inside and outside actuators may be configured to move in the second direction without retracting the first retractable latch. The lockset may further comprise a lever configured to move downward in the first direction and upward in the second direction. The first retractable latch may further comprise a one-direction (one-way) latch cam (previously referred to as a latch hub cam) configured to be rotatable by 90° or more during installation to operate in an oppositely handed door (thus maintaining the first and second directions of movement of the first inside and/or outside actuators). The lockset may further comprise a drive cam, a first reactor plate, a second reactor plate, and a deadbolt trigger (which may trigger a retractable latch and not specifically a deadbolt). The first inside and/or outside actuators may be configured to operate the drive cam, which acts on the first reactor plate, which acts on the second reactor plate, which acts on the deadbolt trigger to retract or lock the second retractable latch. An electronic actuator and/or a switch may activate the deadbolt.

Various changes may be made in the above details without departing from the spirit and scope of the double latch lockset as described. The double latch lockset features several meritorious inventive aspects and advantages. The first is a drive assembly that connects a first retractable latch and a deadbolt within a double latch lockset. The drive assembly comprises a drive cam, a first reactor plate comprising at least two arms, a second reactor plate, and a deadbolt trigger. When the drive assembly is assembled, the first reactor plate and at least two arms at least partially surround the drive cam on at least three sides. The drive cam is configured to act on the at least two arms. The first reactor plate is configured to act on the second reactor plate. The first and second reactor plates may cooperate at pivot points. The second reactor plate is configured to act on the deadbolt trigger. The drive assembly may further comprise a (locking) rack (and pinion) configured to coact with the drive cam and deadbolt trigger (to prevent the drive cam from activation by an outside actuator when the deadbolt trigger is locked). The deadbolt trigger may comprise a gear or an arm that may rotate. An escapement spring may be configured to cooperate between the lever cam and the deadbolt trigger to protect the drive assembly from breakage.

The invention can also be characterized as an actuator-arresting assembly. When the actuator-arresting assembly is assembled, the drive cam is configured to act on the pinion; the pinion is configured to act on the (locking) rack; the (locking) rack is configured to act on the deadbolt trigger; and the (locking) rack is configured, when the deadbolt trigger is locked, to prevent the drive cam from activation by a first outside actuator. The drive cam may be configured, even when the deadbolt trigger is locked, to be activated by a first inside actuator to move the pinion and (locking) rack to unlock the deadbolt trigger.

Other Novelties

Within the context of the broader double latch lockset 10, this specification presents other novel aspects. Each is functional and valuable in its own right and as applied to retractable latches that may be configured to work with locksets other than any lockset 10 presented here. In the same vein, the double latch lockset 10 as disclosed is functional and novel with relatively standard retractable latches and not reliant on the retractable latches and components about to be described. The combination of all the novelties in this specification make for an outstanding lockset.

Retractable Latch Comprising a Latch Hub Cam

Figure 38:
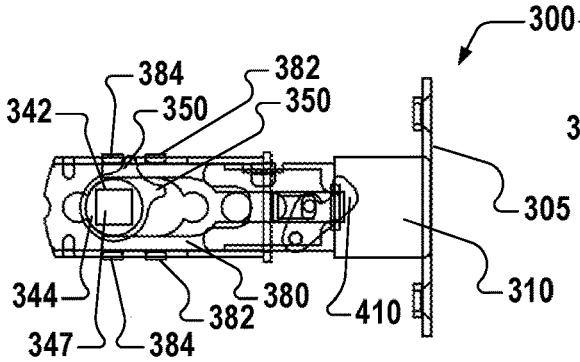
FIG. 38 is a side view of a retractable latch as positioned when a door is closing, with 2-¾" backset.
Figure 39:
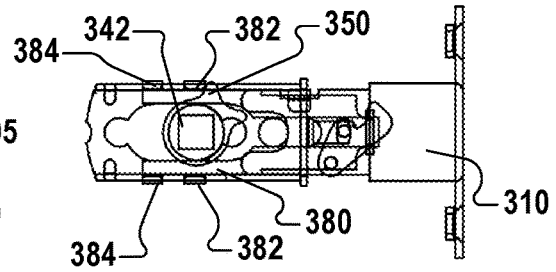
FIG. 39 is a side view of the retractable latch of 38 with a 2-⅜" backset.

FIGS. 38-58 disclose a retractable latch 300 having a latch hub cam or latch cam 342 that allows a latch bolt 310 to retract only with movement of a door handle 31 in a first direction, not in a second direction (for example, lever down, but not up), making them a one-way latch hub cam 342 and a one-way retractable latch 300. The latch hub cam 342 and latch 300 preclude lost motion and are versatile enough to work in eight installed configurations. Those configurations include left hand, left hand reverse, right hand, and right hand reverse doors—each with either 2-⅜" or 2-¾" backset. FIG. 38 shows a 2-¾" backset, and FIG. 39 shows a 2-⅜" backset.

Figure 40:
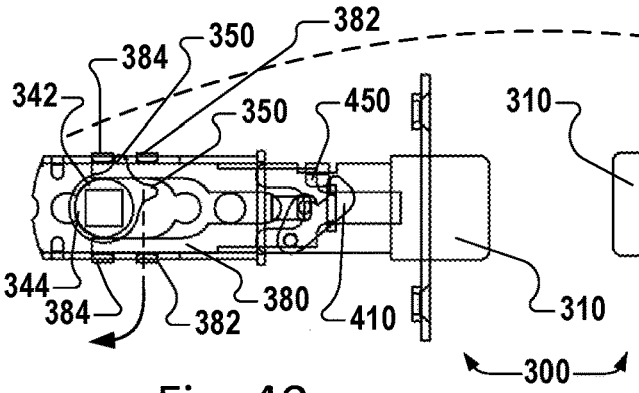
FIG. 40 is the latch of FIG. 38 as positioned when the door is closed.
Figure 41:
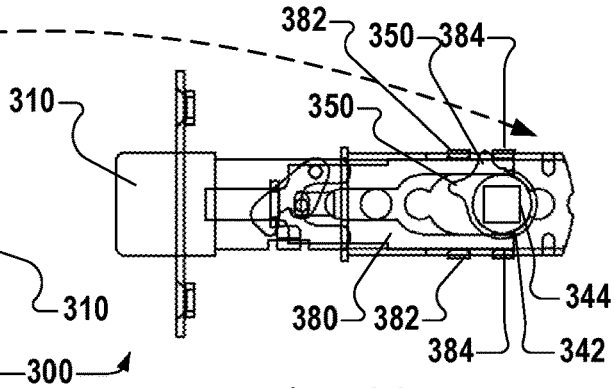
FIG. 41 is the latch of FIG. 40 with the latch hub cam rotated 90°.

First, an overview is provided of the functionality of the retractable latch 300, followed by a discussion of figures that show the parts in more detail. In FIGS. 38 and 39, the parts are oriented as though a door 1 was closing, with the latchbolt 310 retracted. In FIG. 40, the parts are oriented as though the door 1 is closed, with the latchbolt 310 projected into the door jamb. The latch hub cam 342 is positioned in a sliding actuator 380 that slides within a housing, and a finger or projection 350 on the latch hub cam 342 is ready to act on a backset tooth 382 or 384 (depending on the selected backset). To reverse the handedness of the door 1, an installer simply rotates the latch hub cam 342 as indicated by the curved, dashed line/arrow—rotating 90° places the opposing projection 350 against the opposing backset tooth 384—and then flips the entire latch 300 end-over-end as indicated by the long, arching dashed line. The result of this procedure is seen in FIG. 41. In both configurations (FIGS. 40 and 41), movement of a first actuator 30, 40 in a first direction (for example, lever down) will retract the latch bolt 310. One of skill in the art will recognize the versatility and efficiency of this design. "Lever down" in any of the eight configurations will retract the latch bolt 310.

Figure 42:
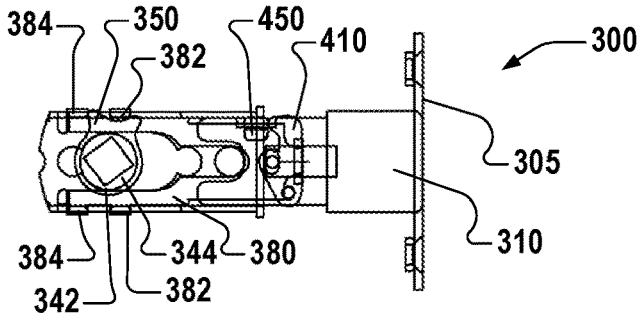
FIG. 42 is the latch of FIG. 38 with bolt retracted as when a lever is pushed down.
Figure 43:
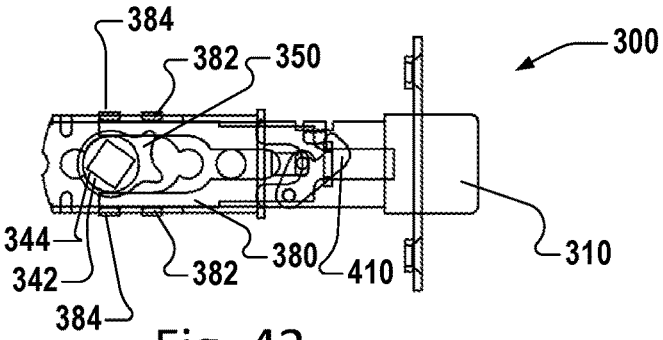
FIG. 43 is the latch of 38 with bolt remaining in place when the lever is pushed up.
Figure 44:
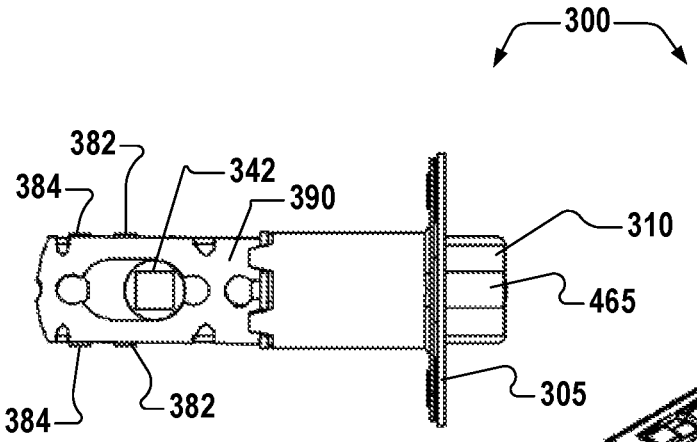
FIGS. 44 and 46 are opposing side views of an assembled retractable latch.
Figure 45:
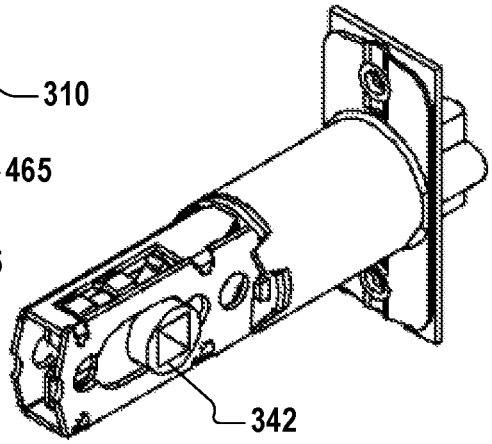
FIGS. 45 and 47 are opposing rear perspective views of the latch of FIG. 44.

FIG. 42 is the same retractable latch 300 as in FIG. 40, but the parts are oriented as though the door 1 is open. In practice, as an actuator 30, 40 turns a tailpiece 42 that runs through an aperture 347 in the hub 344 of the latch hub cam 342 in a first direction (for example, lever down), the latch hub cam's finger or projection 350 pushes back on a backset tooth 384, thereby moving the sliding actuator 380 away from the faceplate 305 and pulling slide cam 410 in cooperation with slide cam pivot 420, which in turn pulls a tab 450 on the latch bolt assembly 311 and retracts the latch bolt 310. In this fashion, the slide cam 410 acts as a multiplier, causing the latch bolt 310 to move farther than the sliding actuator 380 moves. Very importantly, the retractable latch 300 is spring loaded, and the projection 350 begins right up against the backset tooth 384 . . . force from the spring 438 urges the first projection 350 against the first tooth 382. When motion begins in the first direction (for example, lever down), there is no lost motion, and the projection 350 immediately acts on the tooth 384. Other configurations using different teeth 382, 384 likewise permit no lost motion. Movement of an actuator 30, 40 in a second direction (for example, lever up) has no effect on the sliding actuator 380, thus allowing the latch bolt 310 to remain seated with the door 1 closed, as shown in FIG. 43. Stated differently, the latch cam 342 is operative through movement of the first inside and/or outside actuator 30, 40 in only the first direction, but not an opposite direction.

Figure 48:
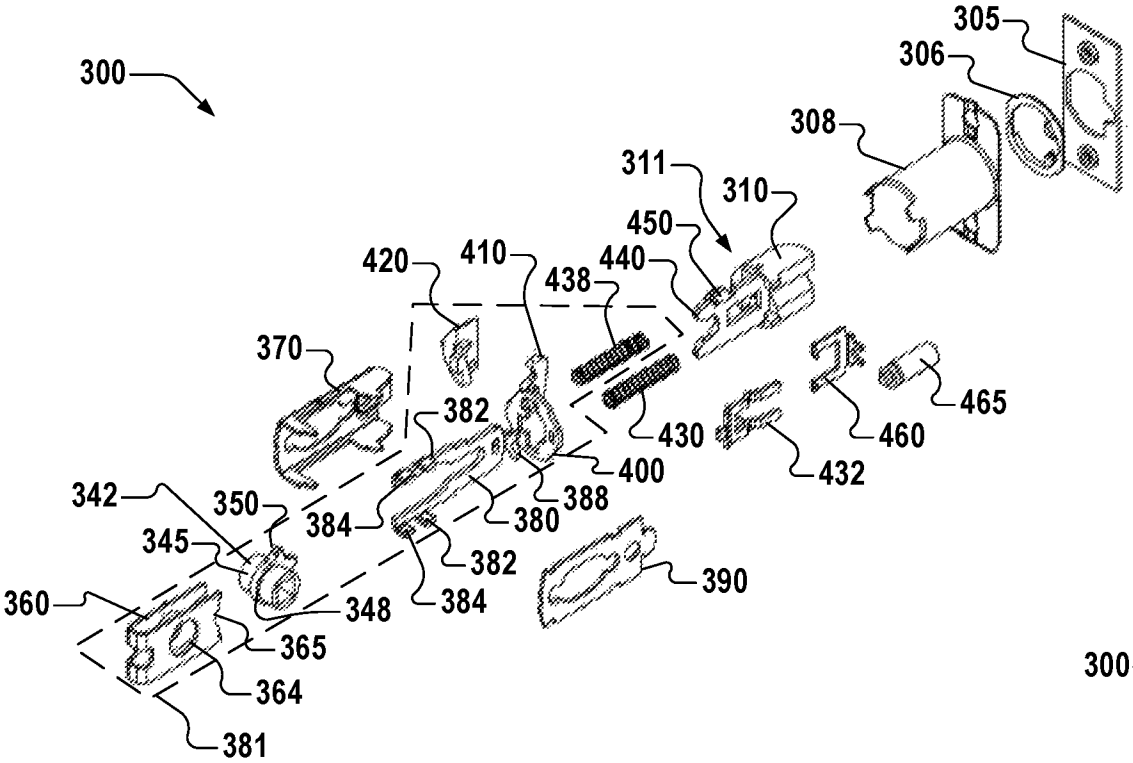
FIG. 48 is an exploded view of the latch of FIG. 45.
Figures 50, 51:
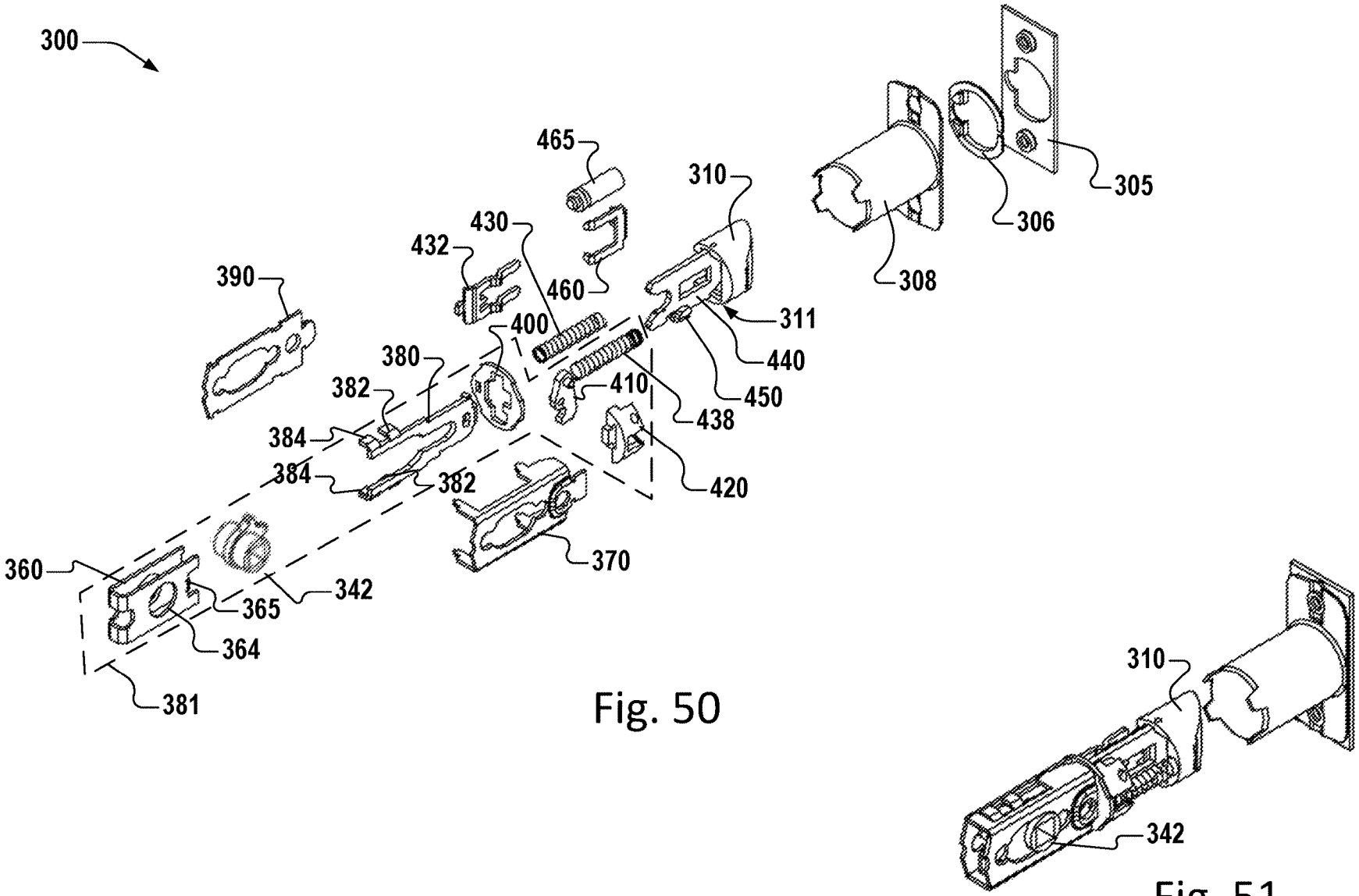
FIG. 50 is an exploded view of the latch of FIG. 47.
FIG. 51 is a partially assembled view of the latch of FIG. 47.
Figure 52:
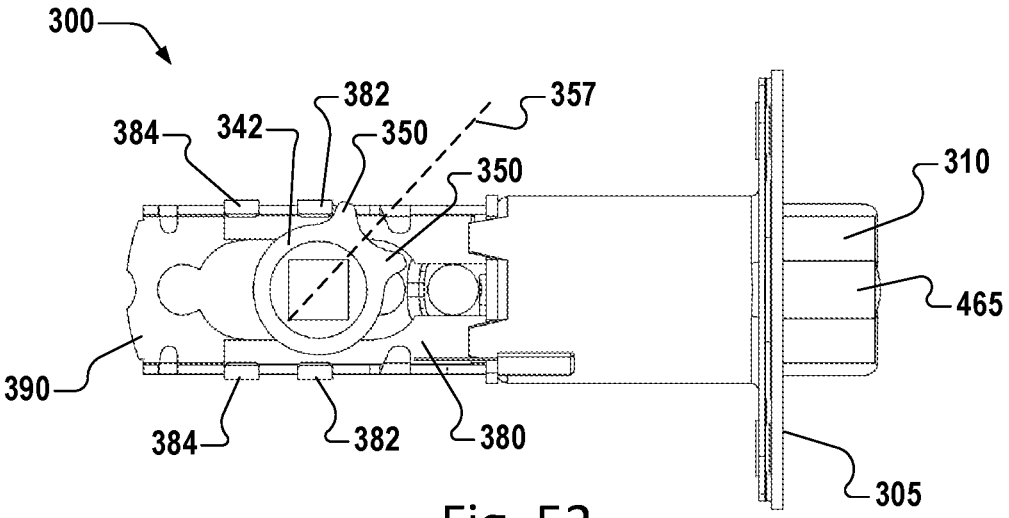
FIG. 52 illustrates the latch cam of FIG. 40.
Figure 53:
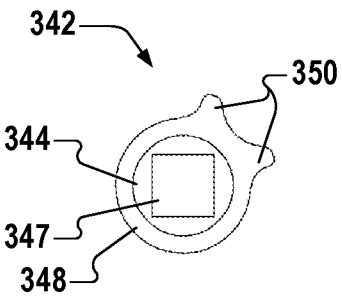
FIG. 53 is a plan view of the latch hub cam of FIGS. 52 and 41.
Figure 54:
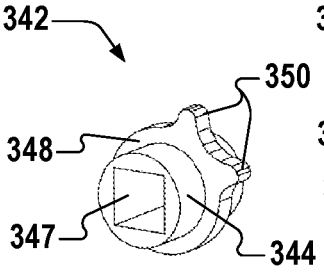
FIG. 54 is a top perspective view of the latch hub cam of FIGS. 52 and 30.
Figure 55:
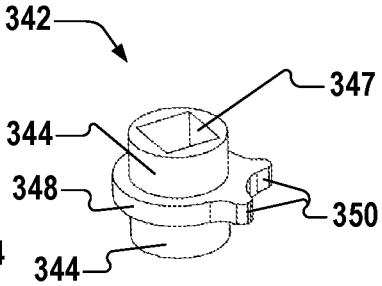
FIG. 55 is a bottom perspective view of the latch hub cam of FIGS. 52 and 30.
Figure 56:
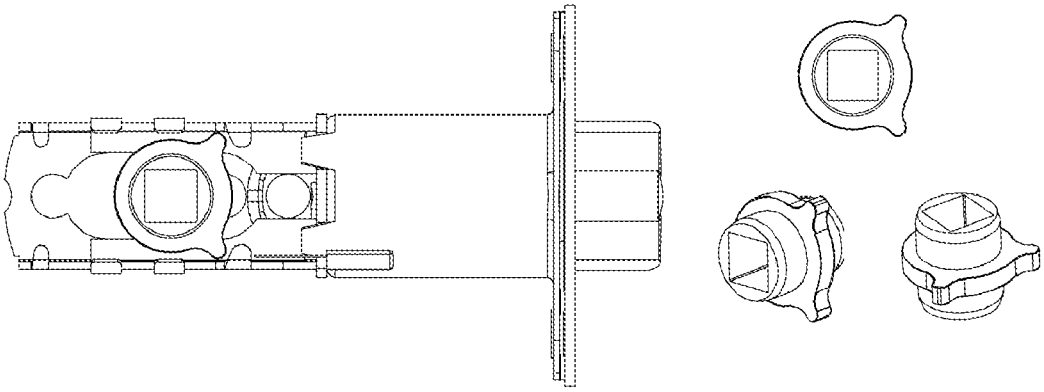
Fig. 56 (PRIOR ART)
FIG. 56 shows a Prior Art latch and latch cam.

Having given an overview of the functionality of the retractable latch 300, attention is turned to the detailed drawings. FIGS. 44-47 are various views of an assembled retractable latch 300. FIGS. 48 and 50 are exploded left hand reverse and left hand views, respectively. FIGS. 52-55 show the latch hub cam 342 close up.

A latch hub cam 342 has a hub 344 that may resemble a barrel or sleeve having an outer surface 435, a square aperture 342 (fitted for the tailpiece 42, shown elsewhere, of an actuator 30, 40) having a diagonal 357, a ring 348 about the outer surface 345 at the center of the hub 344, and at least one finger or projection 350 extending outwardly from the ring 348. The latch hub cam 342 may have two or more projections 350 and may be of varied design provided similar functionality remains. The latch hub cam 342 rotatably rests on its outer surface 345 within the apertures 364 on either side of a u-shaped latch hub holder 360, the ring 348 keeping the hub 344 centered. The latch hub holder 360 is inserted leading edge 365 forward into a sliding actuator 380 that is located between a housing extension bottom 370 and top 390 and mated with an extension holder 400. A slide cam 410 and slide cam pivot 420 are also mated to the extension holder 400. A latch bolt assembly 311 (comprising a latch bolt 310 and latch bolt tail 440) travels in cooperation with a latch bolt spring 438 and a flange 388 on the sliding actuator 380 as forced by the slide cam 410. A dead locking bar 465 that nestles within the latch bolt 310 travels in cooperation with a dead locking slide 460, a blocker 432, and a blocker spring 432. The latch bolt assembly 311 and dead locking bar 465 assembly feed into the latch housing 308 and latch guide 306 up to the face plate 305.

Figure 46:
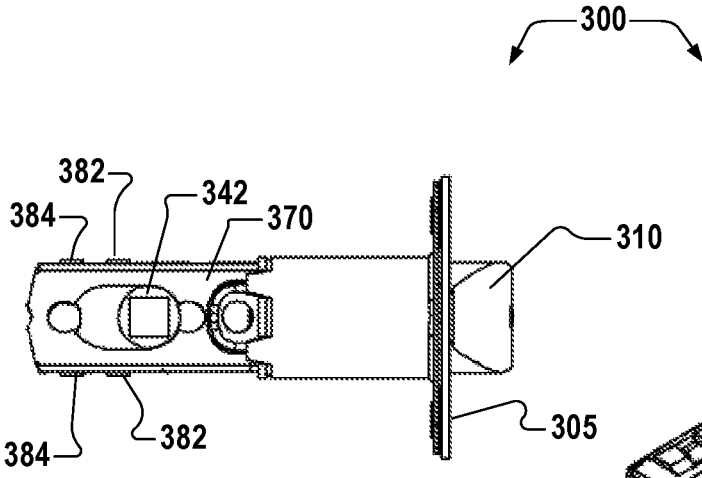
Figure 47:
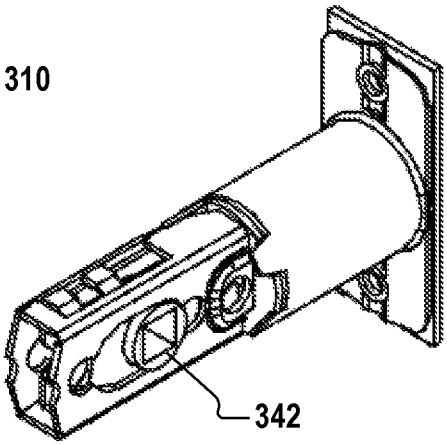
Figure 49:
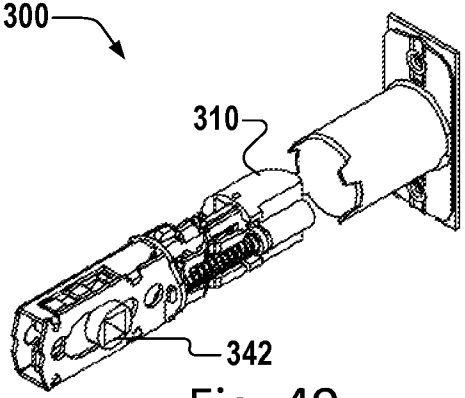
FIG. 49 is a partially assembled view of the latch of FIG. 45.

The latch bolt assembly 311 acts in cooperation with the sliding actuator assembly 381 (shown inside dashed lines in FIGS. 46 & 48). In its simplest form the sliding actuator assembly 381 may comprise a sliding actuator 380, latch hub cam 342, and latch bolt spring 438. In its fuller form, the sliding actuator assembly 381 may further comprise a slide cam 410, cam pivot 420, latch hub holder 360, and extension holder 400, as well as a housing.

In contrast to the present one-way latch hub cam 342, prior art cams (see FIG. 56) must operate in two directions to allow a related actuator to retract a latch by movement in either direction (for example, a knob may turn either direction to retract a latch). Whereas the projection 350 on the present latch hub cam 342 is pressed against a backset tooth 382 or 384 at all times prior to movement, the fingers of the prior art must lose rotation in one or both directions. Typically there is lost motion in both directions because the finger design must be narrow enough to allow the prior art cam to change backset lengths within its housing.

On a related note, FIGS. 57-60 illustrate a latch hub cam 352 with only one projection 350. Note that the tailpiece 42 must remain square as it passes through the latch hub cam 352. To compensate, the hub aperture 367 takes on a different shape, such as a four-tipped blunt-pointed star shape. The result is less efficient in terms of lost motion. Also, this latch cam 352 is rotated 140° to change handedness. One of skill in the art will understand that variations of one or two projections 350 that achieve a similar function, with or without a little lost motion, are within the scope of the present invention.

Persons reasonably skilled in the art will recognize that various changes may be made in the above details without departing from the spirit and scope of the retractable latch comprising a latch hub cam as described. To summarize, the retractable latch comprising a latch hub cam features several meritorious inventive aspects and advantages. The first is a sliding actuator assembly employed in a one-direction (one-way) retractable latch within a door. The sliding actuator assembly comprises a latch cam (elsewhere called a latch hub cam) comprising a hub with an aperture through the length of the hub (for a handle tailpiece) and at least one projection extending outward from the hub, a sliding actuator comprising an elongated body and at least one tooth, and a spring. When the sliding actuator assembly is assembled, it is configured to resist retraction that requires compression of the spring. The at least one projection on the latch cam is positioned substantially parallel to the length of the sliding actuator's elongated body, and the projection is held against the at least one tooth by the sliding actuator's resistance to retraction. The latch cam is configured to rotate in one direction for the projection to push the at least one tooth and retract the sliding actuator, and is configured to rotate in an opposite direction with the projection having no effect on the sliding actuator. The latch cam is configured to be rotated during installation to set the sliding actuator assembly to operate in an oppositely handed door. The latch cam may be rotated by 90° or more. After rotation, the projection may act on a second tooth. The projection acts on the tooth with zero lost rotation, whether the door is right or left handed. The latch cam may further comprise a square aperture and at least two projections extending outward from the hub, and may extend from one side of the hub, wherein the at least two projections are symmetrically opposed with reference to a diagonal of the square aperture. The latch cam may comprise a ring about the outer surface of the hub, wherein the distance between the ends of the at least two projections is less than the diameter of the hub ring. The distance between the ends of the at least two projections may approximate the length of a diagonal of the square aperture.

A second meritorious inventive aspect and advantage of the retractable latch comprising a latch hub cam is the one-direction (one-way) latch cam itself.

A third meritorious inventive aspect and advantage of the retractable latch comprising a latch hub cam is the retractable latch itself, comprising at least a latch housing, a latch bolt assembly, and a sliding actuator assembly with latch hub cam as described herein. The sliding actuator assembly may comprise a latch bolt tail as described below.

Retractable Latch Comprising a Latch Bolt Tail

FIGS. 61-66 show a latch bolt tail 440 having a generally planar body and head 442 that joins with a latch bolt 310 to form a latch bolt assembly 311. A tab 450 projects outwardly from a side of the latch bolt tail 440 to cooperate with a slide cam 410 (shown previously). A first portion of the tab 450 is generally perpendicular to the body and turns into a second portion of the tab 450 that extends downward, generally parallel to the body. The tab 450 is configured to be releasably engaged by, or catch, the slide cam 410 and to make the latch bolt 310 movable/retractable. The latch tab 450 is also configured to wrap around an edge of a sliding actuator 380 in order to help hold the latch bolt tail 440 and the sliding actuator 380 in parallel.

The latch tab 450 of the present invention is sturdier than tabs of the prior art, such as lanced tabs, as the profile of the tab 450 puts its mass (and its bends) perpendicular to the force applied by the slide cam 410. For example, in U.S. Pat. No. 6,419,288 to Wheatland, a lanced prong (102) is bent in the same direction as the force applied by the cam lever (104), and the prong is not configured to hold the activator (100) in parallel with the latch bolt tail (86). In contrast, the advantages of the present invention allow for fewer, stronger parts within the surrounding latch.

For example, the link (112) is unnecessary.

Persons reasonably skilled in the art will recognize that various changes may be made in the above details without departing from the spirit and scope of the retractable latch comprising a latch bolt tail as described. In summary, the retractable latch comprising a latch bolt tail features several meritorious inventive aspects and advantages. The first is a latch bolt tail comprising a generally planar body configured to mate with a latch bolt, and a tab comprising a return flange configured to wrap around at least an edge of a sliding actuator and releasably engage or catch a slide cam attached to the sliding actuator (the edge of the tab may catch the slide cam as it rotates). The planar body and the tab are configured to hold the sliding actuator parallel to the planar body as the latch bolt moves.

A second meritorious inventive aspect and advantage of the retractable latch comprising a latch bolt tail is a latch bolt slide assembly comprising a latch bolt, latch bolt tail, and sliding actuator assembly.

A third meritorious inventive aspect and advantage of the retractable latch comprising a latch bolt tail is the retractable latch itself, comprising at least a latch housing, a latch bolt assembly comprising a latch bolt tail as described herein, and a sliding actuator assembly.

CONCLUSION

Kits are envisioned comprised of various combinations of the novelties discussed in this specification, including, but not limited to a first retractable latch, a second retractable latch, a deadbolt, inside and/or outside actuators for the latches, drive assemblies, clutch assemblies, a locking rack and pinion, sliding actuator assemblies, latch cams, latch bolt assemblies, and a latch bolt tail.

Various electronic actuators, switches, controllers, and other devices may be employed with the double latch lockset and its components. The resultant locksets may be fully or largely mechanical, electronic, or a combination thereof. Parts may be made of various materials as warranted, including metal, carbon, polymers, and composites.

It will be understood that many modifications could be made to the embodiments disclosed herein without departing from the spirit of the invention. Having thus described exemplary embodiments of the present invention, it should be noted that the disclosures contained in the drawings are exemplary only, and that various other alternatives, adaptations, and modifications may be made within the scope of the present invention. Accordingly, the present invention is not limited to the specific embodiments illustrated herein, but is limited only by the following claims.

We claim:

1. A sliding actuator assembly employed in a retractable door latch, the sliding actuator assembly comprising:

a retract slide comprising an elongated body and oppositely disposed first and second teeth; and a spring that resists retraction of the retract slide;

wherein:

the latch cam comprises:

a hub configured to rotate on a door handle spindle through an aperture of the hub;

a first tooth camming projection extending outward from the hub; and a second tooth camming projection extending outward from the hub;

the latch cam is configured to be installed in one of two selectable orientations with respect to the door handle spindle, a first one of said orientations being for a left-handed door, and a second one of said orientations being for a right-handed door;

when the latch cam and a spindle upon which it rotates is in an intermediate position and the latch is projected, the selected latch cam orientation determines whether the first tooth camming projection is positioned adjacent the first tooth or the second tooth camming projection is positioned adjacent the second tooth; and an angle R representing an amount of handle and corresponding latch cam rotation required to move the latch from a resting, projected position to a fully retracted position is less than or equal to an angle F representing the angle between the first and second selectable latch cam orientations;

whereby when installed, the latch cam is operative to retract the retract slide when a coupled door handle is rotated in only a first rotational direction, such that rotation of the coupled door handle in a second rotational direction opposite the first rotational direction is inoperative to retract the sliding actuator.

2. The sliding actuator assembly of claim 1, wherein the first and second projections enable the hub to be installed in either a right-handed configuration for a right-handed door or a left-handed configuration for a left-handed door, wherein the first projection is operative in only a right-handed configuration for use in a right-handed door, and the second projection is operative in only a left-handed configuration for use in a left-handed door.

3. The sliding actuator assembly of claim 2, wherein:

the first and second tooth camming projections are spaced apart such that when the sliding actuator assembly is installed with a right-handed configuration for use in a right-handed door, the first projection is operative to engage the first tooth to retract the sliding actuator and the second projection is unable to come into contact with the second tooth;

when the sliding actuator assembly is installed with a left-handed configuration for use in a left-handed door, the second projection is operative to engage the first tooth to retract the sliding actuator and the first projection is unable to come into contact with the first tooth.

4. The sliding actuator assembly of claim 1, wherein the first projection acts on the first tooth with zero lost motion, whether the door is right- or left-handed.

5. The sliding actuator assembly of claim 1, the latch cam further comprising a square aperture, wherein the first and second projections are symmetrically opposed with reference to a diagonal with respect to a side of the square aperture.

6. The sliding actuator assembly of claim 1, further comprising a ring about the outer surface of the hub, wherein the distance between the ends of the first and second projections is less than the diameter of the hub ring.

7. The sliding actuator assembly of claim 6, wherein the distance between the ends of the first and second projections approximates the length of a diagonal of the square aperture.

8. The sliding actuator assembly of claim 1, wherein:

only four discrete directions exist in which the hub can be installed on the spindle;

the handle has a limited range of rotation clockwise and counterclockwise from a middle neutral position;

the first and second orientations are 90° apart, corresponding to two of the four discrete orientations;

in the first orientation, the first tooth camming projection is positioned adjacent the first tooth so that motion in a first rotational direction, which is either clockwise and counterclockwise, causes the tooth camming projection to push the first tooth to retract the latch;

in the first orientation, the second tooth camming projection is laterally offset from a first position between the first and second teeth;

in the first orientation, the second tooth camming projection is distal enough from the second tooth that motion in the second rotational direction, all the way to the extent of the limited range of rotation of the handle, is insufficient to bring the second tooth camming projection into contact with the second tooth;

in the second orientation, the second tooth camming projection is positioned adjacent the second tooth so that motion in a in a third rotational direction, which is either clockwise and counterclockwise, causes the second tooth camming projection to push the second tooth retract the latch;

in the second orientation, the first tooth camming projection is laterally offset from a second position between the first and second teeth;

in the second orientation, the first tooth camming projection is distal enough from the first tooth that motion in a fourth rotational direction opposite the third rotational direction, all the way to the extent of the limited range of rotation of the handle, is insufficient to bring the first tooth camming projection into contact with the first tooth.

9. The sliding actuator assembly of claim 1, further comprising:

an angle D between the first and second tooth camming projections is less than or equal to an angular span M between the first tooth in the first orientation and the second tooth in the second orientation while the latch remains projected, minus 90°; and wherein an amount R of spindle rotation in order to completely retract the latch is less than 90°.

10. A latchset comprising:

a sliding actuator comprising an elongated body and a first tooth;

a latch cam comprising:

a hub configured to rotate on a spindle turned by and coaxial with a door handle through an aperture of the hub; and a first tooth camming projection extending radially outward from the hub;

a second tooth camming projection, angularly displaced from the first tooth camming projection, extending radially outward from the hub;

a spring that resists retraction of the sliding actuator and urges the first tooth against the first camming projection;

wherein:

the latch cam is configured to be installed in one of a first and second orientations with respect to the spindle;

the first orientation positions the first tooth camming projection adjacent the first tooth while keeping the second tooth camming projection out of contacting reach of the second tooth throughout the door handle's range of rotation, which extends in opposite directions from a default, intermediate position;

the second orientation positions the second tooth camming projection adjacent the second tooth while keeping the first tooth camming projection in a position out of contacting reach of the first tooth throughout the door handle's range of rotation;

wherein when installed, the latch cam is operative to retract the sliding actuator when a coupled door handle is rotated in only one rotational direction, such that rotation of the coupled door handle in the opposite rotational direction is inoperative to retract the sliding actuator.

11. The latchset of claim 10, wherein the first projection acts on the first tooth with zero lost rotation, whether the door is right or left-handed.

12. The latchset of claim 10, further comprising a ring about the outer surface of the hub, wherein the distance between the ends of the first and second projections is less than the diameter of the hub ring.

13. The latchset of claim 10, wherein the first and second projections are symmetrically opposed with reference to a diagonal of the aperture.

14. A latch cam employed in a retractable latch within a door, the latch cam comprising:

a hub comprising an aperture for receiving a rectangular spindle; and at least a first projection extending outwardly from the hub;

wherein:

with respect to a fixed frame of reference, the hub is configured to be installed in one of a selectable first and second angular orientations and in one of two selectable backset positions;

the first angular orientation enables, for right-handed doors but not left-handed doors, latch retraction in only a first direction, not in two opposite directions;

when the hub is installed in the first angular orientation on a left-handed door, latch retraction is only possible in a second direction opposite the first direction;

the second angular orientation enables, for left-handed doors but not in right-handed door, latch retraction in the first direction, not in the two opposite directions;

when the hub is installed in the second angular orientation on a right-handed door, latch retraction is only possible in the second direction opposite the first direction; and in each of the two orientations, the latch cam supports a range of handle rotation extending from a neutral, intermediate position to opposite angular limits on either side of the neutral, intermediate position, while rotation toward only one of said limits is operable to retract the latch.

15. The latch cam of claim 14, further comprising a second projection extending outwardly from the hub and a ring about the outer surface of the hub, wherein the distance between the ends of the first and second projections is less than the diameter of the ring.

16. The latch cam of claim 14, further comprising a second projection extending outwardly from the hub, wherein the distance between the ends of the first and second projections approximates the length of a diagonal of the square aperture.

17. A latchset comprising:

a deadbolt linkage that moves a deadbolt between retracted and projected positions;

a spindle to which the deadbolt linkage is mounted, wherein movement of a handle attached to the spindle in one direction drives the deadbolt into a projected position, and movement of the handle in an opposite direction drives the deadbolt into a retracted position;

a latch cam comprising an aperture configured to receive and be operated by the spindle; and a retract slide operated by the latch cam to retract a latchbolt;

wherein the latch cam is configured to be installed in a one of two selectable orientations 90° apart, a first orientation of which sets the latch cam to operate in a right-handed door and a second orientation of which sets the latch cam to operate in a left-handed door;

wherein in movements of the spindle to project the deadbolt, the first and second orientations of the latch cam both prevent said spindle movement from retracting the latch.

18. The latch set of claim 17, wherein the latch cam comprises a hub and first and second camming projections extending outwardly from the hub, wherein the first and second projections are symmetrically disposed on opposite sides of a diagonal line through the aperture.

19. The latchset of claimer 18, the latch cam further comprising a ring about the outer surface of the hub, wherein the distance between the ends of the first and second projections is less than the diameter of the ring.

20. The latchset of claimer 18, wherein the distance between the ends of the first and second projections approximates the length of a diagonal of the aperture.

* * * * *